US009140496B2

(12) United States Patent
Smith

(10) Patent No.: US 9,140,496 B2
(45) Date of Patent: Sep. 22, 2015

(54) MAGNETIC DRYING APPARATUS

(71) Applicant: Holly M. Smith, Princeton, NJ (US)

(72) Inventor: Holly M. Smith, Princeton, NJ (US)

( * ) Notice: Subject to any disclaimer, the term of this patent is extended or adjusted under 35 U.S.C. 154(b) by 291 days.

(21) Appl. No.: 13/745,771

(22) Filed: Jan. 19, 2013

(65) Prior Publication Data

US 2013/0133219 A1 May 30, 2013

Related U.S. Application Data

(63) Continuation of application No. 11/605,008, filed on Nov. 28, 2006, now Pat. No. 8,381,413.

(51) Int. Cl.
*F26B 25/18* (2006.01)
*F26B 25/00* (2006.01)

(52) U.S. Cl.
CPC ..... *F26B 25/003* (2013.01); *F26B 25/18* (2013.01)

(58) Field of Classification Search
CPC ..... F26B 25/003; F26B 25/18; A47G 1/17; A41D 27/22
See application file for complete search history.

(56) References Cited

U.S. PATENT DOCUMENTS 2,618,392 A * 11/1952 Keutzer ..... 211/104
3,069,021 A * 12/1962 Gray ..... 211/197
5,778,556 A * 7/1998 Ohsugi ..... 34/106
6,425,490 B1 * 7/2002 Ta ..... 211/116
7,097,144 B2 * 8/2006 Kohno ..... 248/206.5

* cited by examiner

*Primary Examiner* — Jiping Lu
(74) *Attorney, Agent, or Firm* — Nancy R. Gamburd; Gamburd Law Group LLC

(57) ABSTRACT

Exemplary embodiments of a drying apparatus, for drying flexible objects such as bags or gloves, comprise a first suspension couplable to an external support, and a second suspension magnetically couplable to the first suspension. An object is supported between the first and second suspensions through the magnetic coupling. In a first embodiment, the second suspension comprises a magnetic hub and one or more spreaders, which may be fixed, removable, or moveably attached to the magnetic hub, and which may be repositionable between open and closed positions. The spreaders may be flexible, articulated, rigid, repositionable, collapsible, extendable, jointed, forked, hinged, slideable, continuous, or merged, and further may have substantially puncture-resistant terminations. The first suspension also comprises a magnetic member and a suspending member, such as an open hook or a clamp suspending member, for supporting the apparatus with the secured object from or by many types of external supports.

17 Claims, 9 Drawing Sheets

MAGNETIC DRYING APPARATUS

CROSS-REFERENCE TO A RELATED APPLICATION

This application as a continuation of and claims priority to U.S. patent application Ser. No. 11/605,008 filed on Nov. 28, 2006, inventor Holly M. Smith, entitled "Magnetic Drying Apparatus", incorporated by reference herein, and with priority claimed for all commonly disclosed subject matter.

FIELD OF THE INVENTION

The present invention in general is related to passive drying systems and apparatuses and, in particular, is related to a magnetic drying apparatus for supporting and holding open a flexible object, such as a bag or glove, during a drying process.

BACKGROUND OF THE INVENTION

With increasing interest in global environmental preservation and ecology, there is an increased need for reusing or recycling various commonly used and non-biodegradable objects, for example, plastic storage bags typically utilized for food storage. Many of these plastic storage bags and other non-biodegradable objects are also expensive, which further creates an economic incentive for their reuse. After such a storage bag is used, it may be washed or rinsed for reuse. Effective evaporative drying generally requires the storage bag to be positioned with its open end downward, to aid the evacuation of excess water and to prevent pooling of water in the bottom of the bag. The extreme flexibility of the bag's material makes sustaining it in this position difficult. Moreover, the wet sides of such a washed or rinsed plastic bag tend to stick together, typically precluding evaporation of remaining water and potentially encouraging the growth of molds, mildew, bacteria, or other possible pathogens.

While turning bags inside-out may improve the drying of the wet sides, the bags are typically damaged in the process, particularly the corners and seams of the bags, rendering them unfit for continued use. In addition, both the inside and outside of the bags must be dried, essentially requiring two separate drying cycles (both inside-in and inside-out). As a consequence, various devices have been created to maintain bags in an open position to allow passive (i.e., evaporative) drying in one or more drying cycles, or for placement and stability in a dishwashing machine with active, heated drying and/or subsequent evaporative drying.

The evaporative drying devices of the prior art, however, have various problems associated with their typical use, such as in a kitchen environment. The associated drawbacks include, among others, requirements for supporting bases, complicated manufacture and assembly of many parts, required use of limited counter space, difficulty storing the device, lack of suitable surfaces for suspension, and required user involvement throughout the drying process. For example, Crutcher U.S. Pat. No. 5,421,542 discloses an adjustable plastic bag dryer which must be supported from below, such as by a kitchen counter. Such a dryer is impractical when kitchen counter space is limited, which is very common. In addition, the adjustable plastic bag dryer of U.S. Pat. No. 5,421,542 requires the manufacture and assembly of many separate parts, at considerably increased expense. It further requires a supporting base, which must be physically separated from the remainder of the apparatus for compact storage, increasing the likelihood of the loss of requisite parts and making storage of the device problematic and impractical in a typical home.

Another prior art drying device disclosed in Gyr et al. U.S. Pat. No. 5,247,752 has a complicated structure of hangers coupled to a moveable "dilator ring", which maintains the hangers in an open position for placement of bags over the hangers for drying. This complicated structure is difficult to manufacture, requiring "frustro-conical" holes to be drilled within the dilator ring, with additional machining and assembly of many separate parts, at considerable expense. The drying device of U.S. Pat. No. 5,247,752 also performs comparatively poorly, because it is designed for one wall of a bag to rest along the length of a hanger, which results in excessive contact and blocking of airflow to the bag, thereby requiring a user to repeatedly change the position of the bag for adequate drying. In addition, in operation, this device is unsuitable for drying bags of different sizes, either not holding larger bags open sufficiently, not providing sufficient air circulation for drying, or not providing suitable support for smaller bags. This complicated device is also unsuitable for drying of other types of objects, such as gloves or hats. Lastly, this device is comparatively heavy and bulky, and accordingly cannot be hung from most supports typically available in a kitchen, such as a cabinet handle, resulting in required use of a supporting base and corresponding counter space in actual operation.

Another drying device of North et al. U.S. Pat. No. 5,102,076 provides for a magnetically suspended plastic bag dryer, having two nested, rotating rings to hold a bag in an open position, attached to a magnet for suspending the bag from a ferromagnetic surface. Most modern kitchens, however, with wood or laminate cabinets, matching wood or laminate panels for appliances, and stone, composite or laminate counters, have very few ferromagnetic surfaces. Such ferromagnetic surfaces are generally limited to certain types of refrigerator doors and sides, which are typically already covered with notes and photographs, for example, which would typically be damaged by contact with a wet surface of a drying object. In addition, such surfaces are vertical; the device of North et al. U.S. Pat. No. 5,102,076 would then require that the bag be suspended either sideways or from the side, decreasing its effectiveness and allowing water to pool within the bag or drip down the side of the refrigerator or onto another surface. Other potential ferromagnetic surfaces in a modern kitchen would include under-cabinet lighting, which would be unsuitable for suspending a wet bag, due to heat and electrical considerations. In addition, the ring structure of North et al. U.S. Pat. No. 5,102,076, even when in a closed or nested position, is also comparatively bulky for storage. For example, ring structures large enough to support a sizable plastic bag would not fit or would use excessive space within a typical kitchen drawer, making storage of the device impractical.

As a consequence, a need remains for a passive drying apparatus which provides for significant air circulation for readily drying an object, such as a plastic bag or an article of clothing, and which requires no user involvement during the actual drying process. Such an exemplary apparatus should be able to be suspended from many types of supports, and while it may also be operable with an optional supporting base, it should not require such a supporting base and use of limited counter space. Such an exemplary passive drying apparatus should have very few parts, should be comparatively easy to manufacture, and should be comparatively inexpensive for a consumer to purchase. An exemplary drying apparatus should provide for ease of storage in a typical kitchen environment, and be adaptable for myriad uses, such as the drying of bags, gloves, hats, and other garments or articles. In addition, an exemplary drying apparatus should have embodiments available which are aesthetically attractive, such that consumers are willing to have them on display when in use for drying.

SUMMARY OF THE INVENTION

As discussed in greater detail below, the various exemplary embodiments of the invention provide innumerable advantages for passive drying of many types of objects such as plastic bags, gloves, mittens, hats, bicycling and running shorts, other articles of clothing, aluminum foil, plastic wrap, and other objects which are not substantially self-supporting or otherwise maintainable in an open position when wet. Various exemplary apparatus embodiments provide for significant air circulation and exposure for readily drying such an object, and once the object is appropriately placed within the apparatus, the various exemplary embodiments do not require any user involvement during the drying process. The exemplary apparatus embodiments provide for securing and holding an object in an open position for drying, and may further provide for suspending or supporting the apparatus with the secured object from or by virtually any type of external support, such as a kitchen cabinet, a curtain rod, or a shelf, for example. Various exemplary apparatus embodiments may be integrally formed or readily assembled with few parts, providing for ease and low cost of manufacture and resulting low cost to consumers. Selected embodiments further provide for repositionable spreaders for holding an object in an open position for drying, which may be manipulated by the user to accommodate different sized objects, and which may be further repositioned into a closed position for compact storage. Exemplary embodiments may also be implemented using aesthetically pleasing, fanciful and/or decorative designs for use in a modern kitchen.

The exemplary apparatus embodiments comprise two separate components, referred to as first and second suspensions (or, equivalently, suspending or supporting structures), which are magnetically couplable to each other utilizing two corresponding magnetic structures. The first and second suspensions may have any of innumerable forms and structures which collectively function, first and in most instances, to secure an object (to be dried) between them, via magnetic coupling, and second, to support and maintain the object in an open position for drying. As discussed in greater detail below, these functions may be distributed between the first and second suspensions in myriad and equivalent ways.

In exemplary embodiments, the first and second suspensions are each in turn comprised of two components: the first suspension may comprise a suspending (or supporting) member coupled to a magnetic member, and the second suspension may comprise a magnetic hub coupled to one or more spreaders which are utilized to maintain an object in an open position for drying. An object is magnetically held or secured between the first and second suspensions. For example, a second suspension may be inserted into the inside of a plastic bag, with one or more spreaders holding the bag in an open position, followed by placing the first suspension on the outside of the plastic bag and magnetically coupling it to the second suspension, with the magnetic force effectively clamping and thereby securing the object between the first and second suspensions. The apparatus with the secured object may then be suspended (via a suspending member of the first suspension) from or otherwise supported by any type of external support (e.g., a cabinet, knob, rod, counter, etc.), and the object allowed to dry. Following drying, the first and second suspensions may be uncoupled, removed from the bag, and manipulated into a suitable position for compact storage.

An exemplary embodiment of the invention provides a passive drying apparatus which comprises a first suspension and a second suspension which is magnetically couplable to the first suspension. In a first embodiment, the second suspension comprises a first magnetic hub and a first spreader coupled to the first magnetic hub. In another embodiment, the second suspension comprises a first magnetic hub and a first plurality of spreaders coupled to the first magnetic hub.

In various exemplary embodiments, at least one spreader is moveably coupled to the first magnetic hub, or is non-moveably coupled to the first magnetic hub, or is removably coupled to the first magnetic hub, or is integrally formed with the first magnetic hub. In another exemplary embodiment, at least one spreader is repositionable between open and closed positions. For example, in a selected embodiment, a first spreader of the first plurality of spreaders is non-moveably coupled to the first magnetic hub and a second spreader of the first plurality of spreaders is moveably coupled to the first magnetic hub and repositionable between open and closed positions. In another exemplary embodiment, all of the spreaders of the first plurality of spreaders are moveably coupled to the first magnetic hub and repositionable between open and closed positions. In addition, a first spreader of the first plurality of spreaders may have a comparatively longer length than a second spreader of the first plurality of spreaders.

In exemplary embodiments, the first plurality of spreaders comprises one or more of the following types of spreaders: flexible, articulated, rigid, repositionable, collapsible, extendable, jointed, forked, hinged, slideable, continuous, or merged. An effective length and an orientation of least one spreader of the first plurality of spreaders may be user modifiable. In another exemplary embodiment, each spreader of the first plurality of spreaders has a substantially puncture-resistant termination, i.e., a termination which does not generally tend to puncture the object to be dried. Additionally, the first plurality of spreaders may comprise at least one primary spreader and at least one secondary spreader.

A central shaft may be coupled to the first magnetic hub in selected embodiments. In addition, the first plurality of spreaders may be indirectly coupled to the first magnetic hub through the central shaft. A second magnetic member also may be coupled to the central shaft, for magnetically suspending or supporting a "chaining" or series of successive second suspensions. In another embodiment, a second magnetic hub also may be coupled to the central shaft, with a second plurality of spreaders coupled to the second magnetic hub. Each spreader of the second plurality of spreaders may be elongated and extending from the second magnetic hub to a termination having a substantially smooth and curved surface, with at least one spreader of the second plurality of spreaders being longer than at least one spreader of the first plurality of spreaders. In other exemplary embodiments, a second plurality of spreaders also may be coupled to the central shaft or coupled to at least one spreader of the first plurality of spreaders. The central shaft may be removably, moveably, or non-moveably coupled to the first magnetic hub.

In various exemplary embodiments, the second suspension may further comprise a plurality of struts moveably coupled to the first plurality of spreaders; and a ring moveably coupled to the plurality of struts and moveably coupled to the central shaft. The second suspension may also include a third magnetic structure, to hold or lock moveable spreaders into an open position.

In exemplary embodiments, the first suspension comprises a suspending member couplable to an external support; and a magnetic member coupled to the suspending member. The suspending member may be any type, and may comprise at least one of the following types of suspending members: an open hook arrangement, a hanger arrangement, a closed hook arrangement, a ring arrangement, a suction arrangement, a clamp arrangement, a lateral magnetic suspending member, a flexible hook arrangement, a flexible loop arrangement, an opening arrangement, a bore arrangement, or a supporting base arrangement. In addition, in a selected exemplary embodiment, the first suspension further comprises a plurality of spaced-apart magnetic members coupled to the suspending member.

Also in various exemplary embodiments, the magnetic member of the first suspension further comprises a first magnet and the first magnetic hub of the second suspension further comprises a second magnet. The first and second magnets are respectively coupled to the magnetic member and to the first magnetic hub through respective sockets or surface mounting.

In various exemplary embodiments, at least one spreader of the first plurality of spreaders has at least one of the following: a void, an opening, a cavity, a dimple, a raised bump, or a protrusion. In addition, the first magnetic hub may be formed integrally with a continuous spreader having at least one of the following: a void, an opening, a cavity, a dimple, a raised bump, or a protrusion.

In another exemplary embodiment, a passive drying apparatus is couplable to an external support and comprises a first suspension and a second suspension magnetically couplable to the first suspension. The first suspension comprises a suspending member and a first magnetic member coupled to the suspending member; and the second suspension comprises a first magnetic hub and a first plurality of spreaders coupled to the first magnetic hub, wherein the first magnetic hub is magnetically couplable to the first magnetic member of the first suspension.

In yet another exemplary embodiment, a passive drying apparatus comprises a first suspension and a second suspension magnetically couplable to the first suspension. In the exemplary embodiment, the first suspension comprises a suspending member couplable to an external support, and a magnetic member coupled to the suspending member; and the second suspension comprises a first magnetic hub.

A passive drying apparatus, in another exemplary embodiment, comprises a first suspension, a second suspension magnetically couplable to the first suspension, and a central shaft. The first suspension comprises a suspending member removably couplable to an external support, and a magnetic member coupled to the suspending member, with the magnetic member having a first magnet. The second suspension comprises a first magnetic hub having a second magnet, and a plurality of spreaders coupled to the first magnetic hub. In this embodiment, the central shaft or at least one spreader is moveably coupled to the first magnetic hub.

Numerous other advantages and features of the present invention will become readily apparent from the following detailed description of the invention and the embodiments thereof, from the claims and from the accompanying drawings.

BRIEF DESCRIPTION OF THE DRAWINGS

The objects, features and advantages of the present invention will be more readily appreciated upon reference to the following disclosure when considered in conjunction with the accompanying drawings, wherein like reference numerals are used to identify identical components in the various views, and wherein reference numerals with alphabetic characters (with or without subscripts) are utilized to identify additional types, instantiations or variations of a selected component embodiment in the various views, in which.

DETAILED DESCRIPTION OF EXEMPLARY EMBODIMENTS

Figure 1:
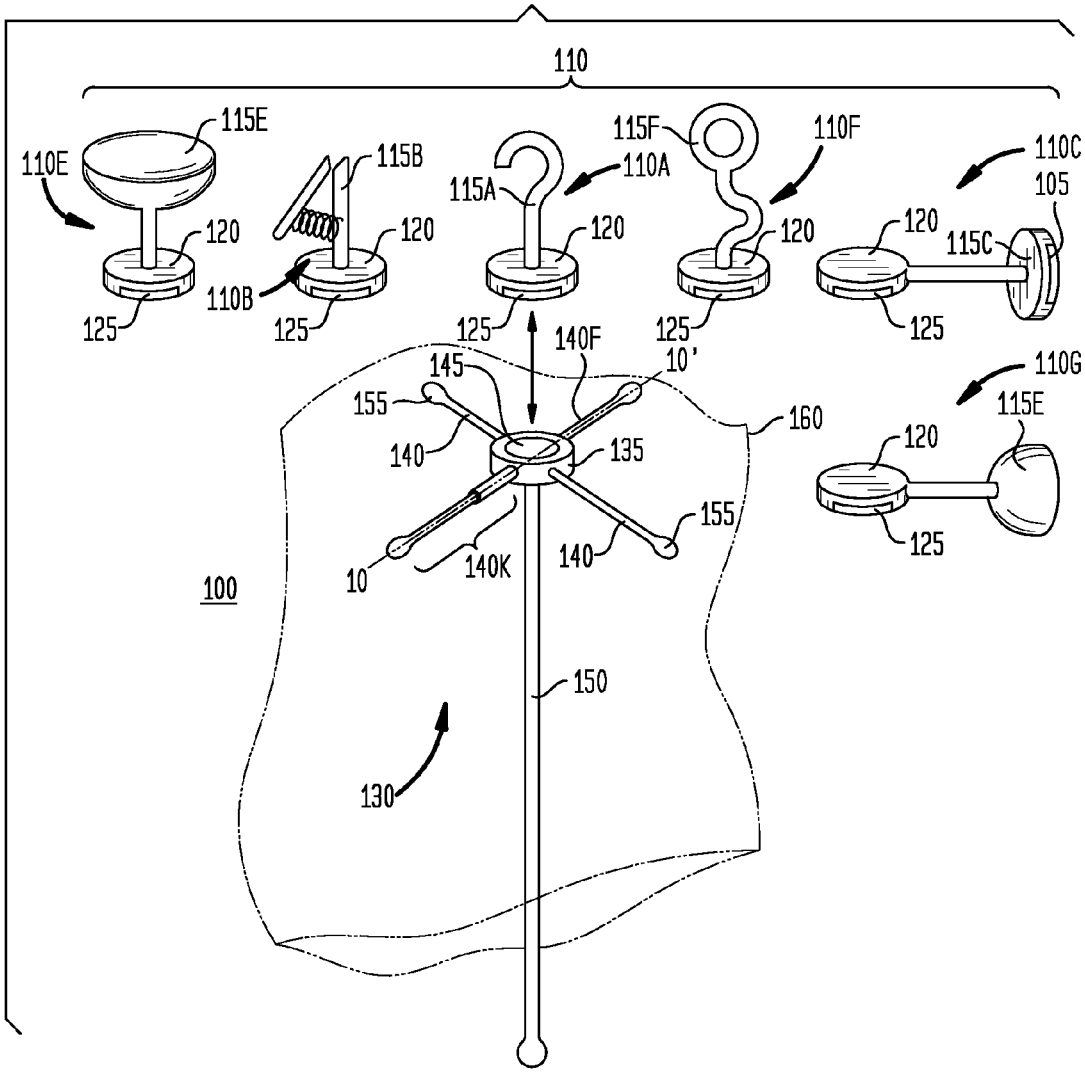
FIG. 1 (or FIG. 1) is a perspective view of a first exemplary apparatus embodiment 100, a first exemplary type of second suspension embodiment 130, and a plurality of types of first suspension embodiments 110 in accordance with the teachings of the present invention.

While the present invention is susceptible of embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, or as described and illustrated in the drawings. Apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

Referring to the drawings, wherein like reference numerals are used to identify identical components in the various views, and wherein reference numerals with alphabetic characters (with or without subscripts) are utilized to identify additional types, instantiations or variations of a selected component embodiment, FIG. 1 is a perspective view of a first exemplary apparatus embodiment 100, a first exemplary type of second suspension embodiment 130, and a plurality of types of first suspension embodiments 110 in accordance with the teachings of the present invention. The exemplary apparatus embodiment 100 comprises two separate suspending or supporting structures, referred to as a first suspension 110 and a second suspension 130, which are magnetically couplable to each other utilizing two corresponding magnetic structures. As indicated above, the first and second suspensions 110, 130 may have innumerable forms and structures which collectively provide two functions: first, to hold or secure an object between them, via magnetic coupling, and second, to support and maintain the object in an open position for drying. These functions may be distributed between the first and second suspensions 110, 130 in many equivalent ways, several of which are illustrated in the Figures and discussed below.

Figure 10:
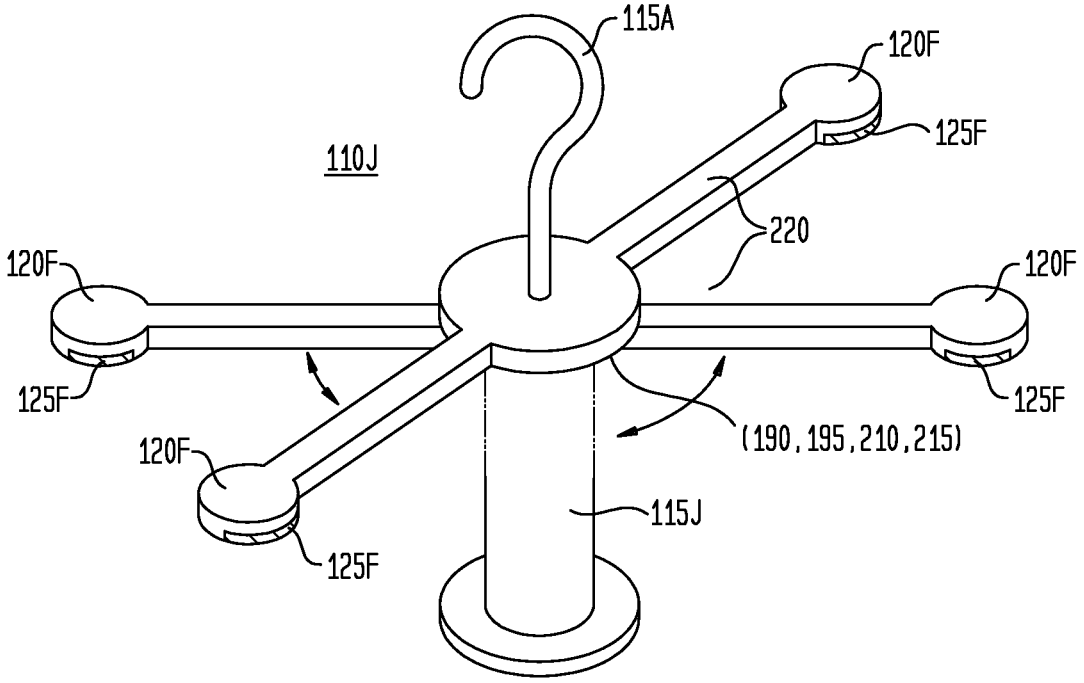
FIG. 10 (or FIG. 10) is a perspective view of a seventh exemplary first suspension embodiment 110J in accordance with the teachings of the present invention.
Figure 11:
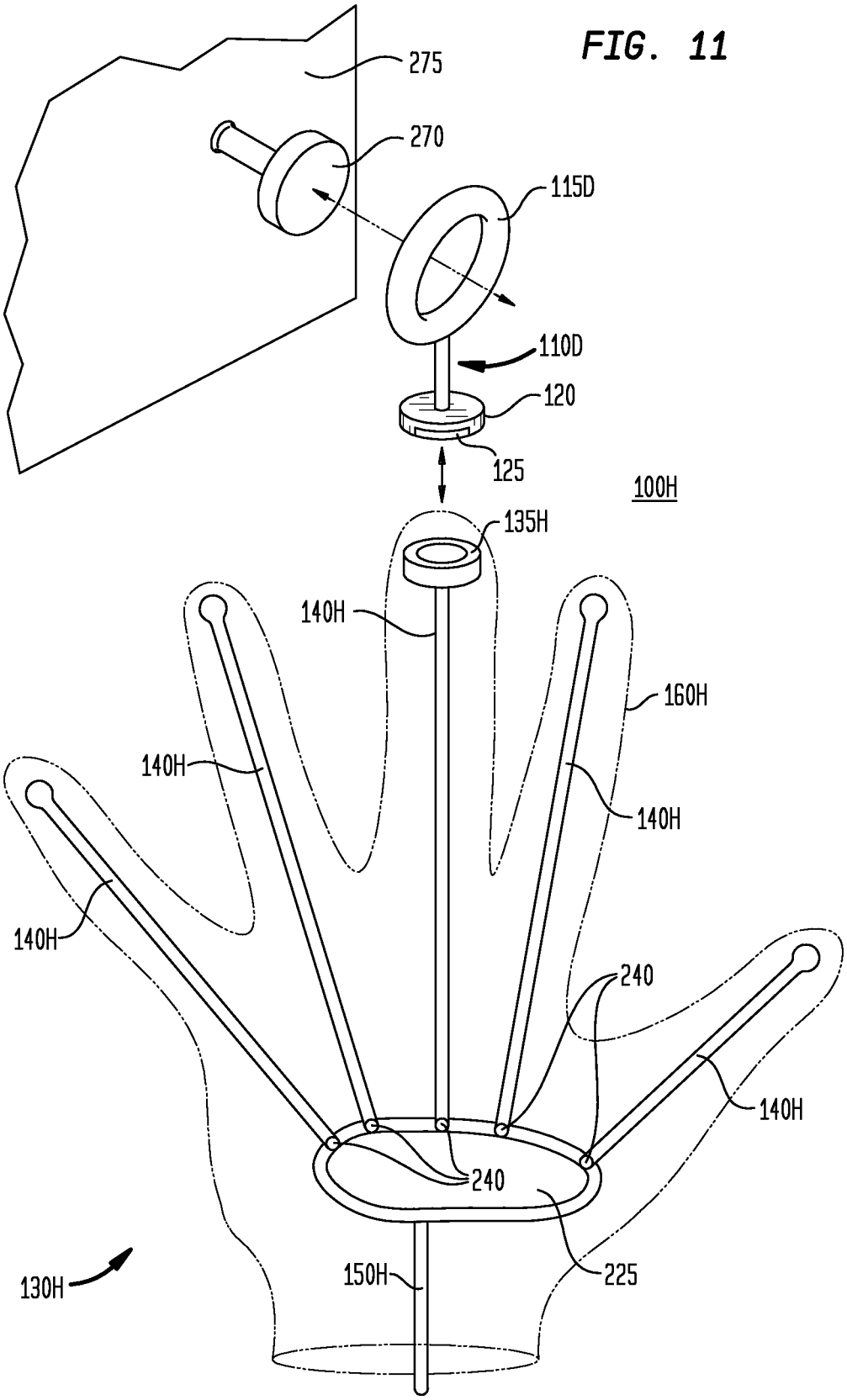
FIG. 11 (or FIG. 11) is a perspective view of a second exemplary apparatus embodiment 100H with an eighth exemplary first suspension embodiment 110D and an eighth exemplary second suspension embodiment 130H in accordance with the teachings of the present invention.
Figure 17:
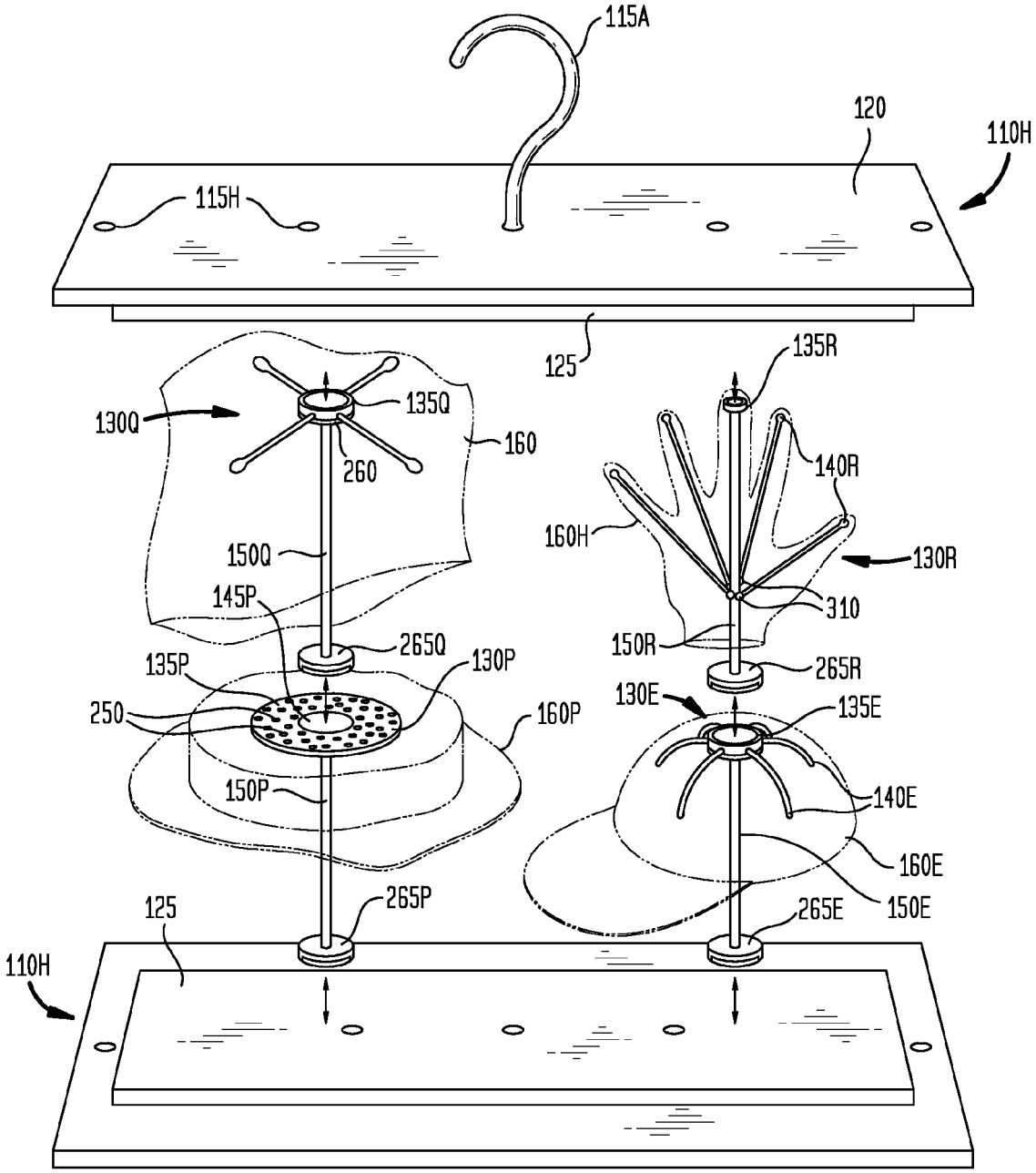
FIG. 17 (or FIG. 17) is a perspective view of additional apparatus embodiments, a ninth exemplary first suspension embodiment 110H, and thirteenth and fourteenth exemplary second suspension embodiments 130R, 130P in accordance with the teachings of the present invention.

Six different exemplary first suspensions 110 are illustrated in FIG. 1 as plurality of different types of exemplary first suspension embodiments 110A, 110B, 110C, 110E, 110F, and 110G, with additional types of exemplary first suspension embodiments 110J, 110D, 110H, and other variations illustrated in FIGS. 10, 11, and 17. The first and second suspensions 110, 130 may be equivalently referred to as first and second suspending or supporting structures, assemblies, arrangements, etc., and each of the first and second suspensions 110, 130 may be integrally formed as unitary components or may be assembled from component parts, as discussed in greater detail below.

Generally, the first and second suspensions 110, 130 are each comprised of two components: the first suspension 110 generally comprises a suspending (or supporting) member 115 coupled to a magnetic member 120, and the second suspension 130 generally comprises a (first) magnetic hub 135 coupled to one or more spreaders 140. As discussed in greater detail below, in various embodiments, a second suspension 130 may be considered to comprise a magnetic hub 135, without separate or distinguishable spreaders 140, such as by having distributed spreaders which are integrated with the magnetic hub 135. Also as discussed in greater detail below, for various apparatus configurations, a second magnetic member (265) may also be coupled to the second suspension 130, such as for "chaining" or stacking a plurality of second suspensions 130 (as illustrated in FIG. 17). In addition to the exemplary embodiments described herein, it will be apparent to those having skill in the art that these components may be embodied by innumerable configurations, structures and forms, all of which are within the scope of the present invention.

Referring to FIG. 1, and as indicated above, the second suspension 130 is magnetically (and removably) couplable to the first suspension 110. In operation, an object 160, such as a bag or glove, is secured between the first suspension 110 and second suspension 130 as illustrated, by magnetic coupling between the first and second suspensions 110, 130. For example, a second suspension 130 can be inserted into the inside of a plastic bag, followed by placing the first suspension 110 on the outside of the plastic bag and magnetically coupling it to the second suspension 130, with the attractive magnetic force holding and securing the object between the first and second suspensions 110, 130. One or more of the plurality of spreaders 140 of the second suspension 130, illustrated in an open or extended position, maintain the object 160 in an open position for passive, evaporative drying. In addition, when the object 160 is a bag as illustrated, generally it should be positioned with its open end downward, to aid the evacuation of excess water and to prevent pooling of water in the bottom of the bag. The apparatus 100 (while securing and holding the object 160 in an open position) may then be suspended from any selected external support (such as an exemplary external support structure illustrated in FIG. 11 as an overhead cabinet 275 with a knob or other handle 270).

Continuing to refer to FIG. 1, the first suspension 110 comprises a suspending member 115 and a magnetic member 120. The magnetic member 120 may further include a magnet 125, or may be merely magnetically attractive, such as comprised of a ferromagnetic material. In selected exemplary embodiments, the suspending member 115 provides for suspending, hanging, attaching, or otherwise supporting the apparatus 100 from or by an external support structure, such as a curtain or closet rod, a cabinet handle, a shelf, a cable, a drying line, a shower curtain rod, a shower head, another hook, an oven door handle, a refrigerator door handle, a counter, and so on. While referred to as a "suspending" member or structure, in exemplary embodiments, the suspending member 115 may comprise innumerable types of supporting or suspending structures, for example, a hanger or hook structure for support of the apparatus from above, or an optional supporting base for support of the apparatus from below, or a bore or an opening suitable for use of a fastener for mounting the apparatus to an external support, and any and all of which are considered equivalent and within the scope of the present invention. Continuing with the example, six different exemplary first suspensions 110A, 110B, 110C, 110E, 110F, and 110G, are illustrated in FIG. 1, with either different types of suspending members 115 (corresponding suspending members 115A, 115B, 115C, 115E, and 115F) or different orientations of the suspending members 115 (115E in first suspension 110G). Another exemplary first suspension 110D, as illustrated in FIG. 11, includes another type of suspending member 115D having a rigid ring structure. In addition, in other exemplary embodiments, the first suspension 110 may include a plurality of magnetic members 120 (first suspension 110J illustrated in FIG. 10), for magnetic coupling with a corresponding plurality of second suspensions 130, and may further include another type of suspending member 115J, embodied as an optional base, for support of the apparatus 100 from below (also discussed with reference to FIG. 10). Another exemplary first suspension 110H, as illustrated in FIG. 17, may include a removable or detachable suspending member 115, illustrated as suspending member 115A, and when removed, allows the first suspension 110H to be inverted and to function as a base-type supporting structure.

A plurality of types of suspending members 115 may be utilized equivalently for suspending, hanging, attaching, mounting or otherwise supporting an apparatus 100 from, to or by an external support, and may be selected by a user depending upon the type, availability and convenience of using a particular external support and whether the suspending member 115 is to be removably attachable or more permanently attached or fixed to an external support. Accordingly, a suspending member 115 may comprise any structure or material which is capable of attaching, removably or more permanently, to an external support. The various exemplary types of suspending members 115, as illustrated in FIGS. 1, 10, 11 and 17, include without limitation: an open hook (or hanger) suspending member 115A; a flexible, closed hook (or loop) suspending member 115F (with a rigid, ring (closed hook or loop) suspending member 115D illustrated in FIG. 11); a suction (or suction cup) suspending member 115E (shown in vertical and lateral embodiments); a clamp (or clip) suspending member 115B; and a lateral magnetic suspending member 115C. As illustrated in FIG. 17, a suspending member 115 also may comprise a structure suitable for use of fasteners or for detachable suspending members, illustrated as bores or openings 115H, and illustrated with a removable suspending member 115A inserted into a bore or opening 115H. The various types of suspending members 115 may be rigid or flexible, as may be necessary or desirable. For example, as illustrated in FIG. 1, a loop or closed hook suspending member 115F may be flexible, such as comprised of cord or fabric, for suspension from a knob of a kitchen cabinet. Other suspending members 115, such as the clamp suspending member 115B, may be utilized to clamp or clip the apparatus 100 to any suitable support, such as to the front of an overhead cabinet or shelf, using pressure from a spring clip, a leaf spring or a coil spring (as illustrated), for example. The suction suspending member 115E may be utilized to suspend an object from a horizontal surface (in first suspension 110E), such as the underside of an overhead cabinet or shelf, or to suspend an object from a vertical surface (in first suspension 110G), such as the side of a cabinet or appliance. In addition, the lateral magnetic suspending member 115C may further comprise a third magnet 105, for laterally or horizontally suspending an object 160 from a vertical surface. It should be noted that selected suspending members 115 may be advantageous, such as for suspending an object 160 from a higher (and therefore warmer) position, for faster drying (e.g., suspending from a curtain or shower rod).

As illustrated in FIG. 1 for first suspension 110E and first suspension 110G, the various suspending members 115 may also have any of a plurality of orientations with respect to the magnetic member 120, such as a suspending member 115 oriented vertically with respect to the magnetic member 120 (suspending members 115A, 115B, 115E (in 110E), 115F), or a suspending member 115 oriented laterally or horizontally with respect to the magnetic member 120 (suspending members 115C and 115E (in 110G)), such as for attaching to a side of an external support. Other types of vertical or lateral suspending members (arrangements or structures) 115 suitable for suspending, hanging, attaching, mounting or otherwise supporting the apparatus 100 (with an object 160) will be apparent to those having skill in the art, and are also considered equivalent and within the scope of the present invention.

Figure 14:
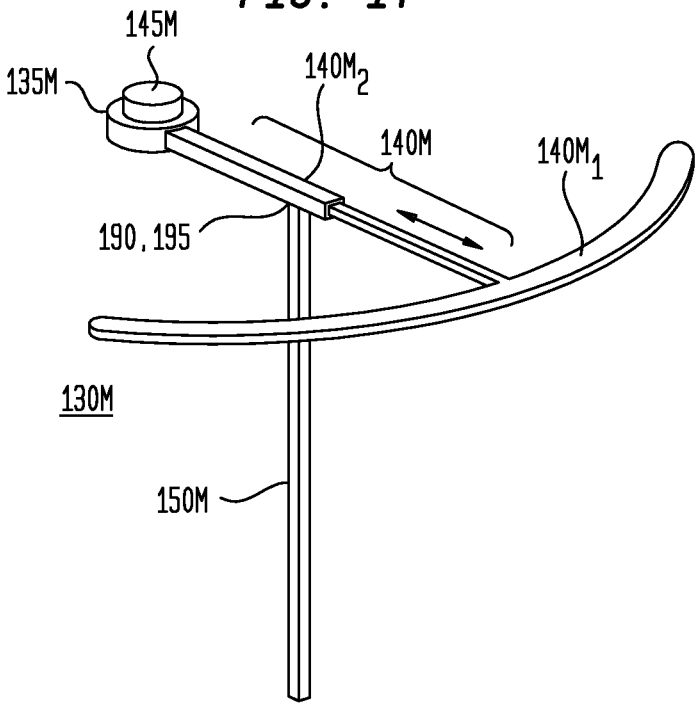
FIG. 14 (or FIG. 14) is a perspective view of an eleventh exemplary second suspension embodiment 130M in accordance with the teachings of the present invention.

The second suspension 130 generally comprises a magnetic hub 135 and one or more spreaders 140 coupled to the magnetic hub 135. The magnetic hub 135 may include a magnet 145, or may be merely magnetically attractive, such as comprised of a ferromagnetic material. In accordance with the invention, only one of the magnetic member 120 or magnetic hub 135 must include some form of a magnet (or magnetic material) 125 or 145. In the illustrated exemplary embodiments, however, both the magnetic member 120 and magnetic hub 135 further comprise a respective magnet 125, 145, to allow the first and second suspensions 110, 130 to be comprised of a non-ferromagnetic material such as wood or plastic, and to increase the magnetically attractive force exerted between the first suspension 110 and the second suspension 130 when in close proximity to each other, allowing the stable support of comparatively heavier objects 160 (for the same sizes of first and second suspensions 110, 130 and respective magnets 125, 145). Each of the magnetic member 120 or magnetic hub 135 may include a socket, bore, depression, slot, cavity, groove, opening or other space into which a magnet 125, 145 may be inserted, illustrated in FIG. 2 for a second suspension 130. A magnet 145 also may be surface mounted on the upper (top) face of a magnetic hub 135 (as illustrated in FIG. 14 for a magnetic hub 135M), and a magnet 125 also may be surface mounted on the lower (bottom) face of a magnetic member 120.

Figure 2:
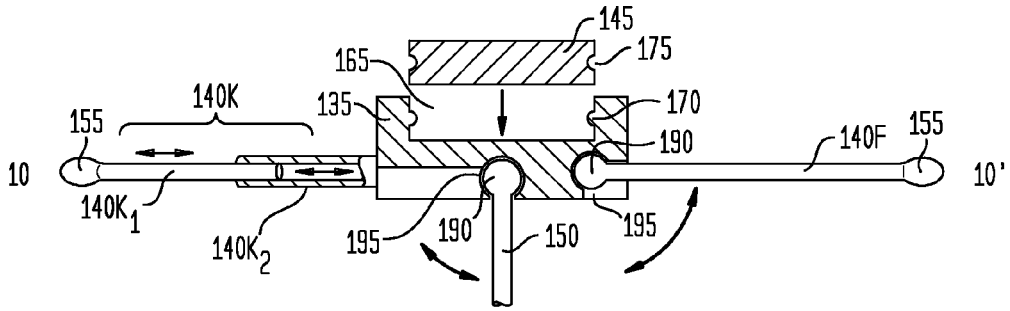
FIG. 2 (or FIG. 2) is a cross-sectional view of a first exemplary second suspension embodiment 130 and a plurality of types of spreaders 140 in accordance with the teachings of the present invention.

FIG. 2 is a cross-sectional view of a first exemplary second suspension embodiment 130 (through the 10-10' plane of FIG. 1) and a plurality of types of spreaders 140 in accordance with the teachings of the present invention, illustrated as spreader 140F and two-part spreader 140K. Spreader 140F is moveably coupled to the magnetic hub 135, using a ball and socket arrangement 190, 195, as discussed in greater detail below, for providing a pivoting capability with respect to the magnetic hub 135. Spreader 140K is an extendable and collapsible (or telescoping) spreader having an adjustable length, and although it could also be moveably coupled to the magnetic hub 135, for purposes of example, its proximal (or sleeve) portion $140K_2$ is illustrated as fixed to the magnetic hub 135 (i.e., non-moveable with respect to the magnetic hub 135), and with its distal (or arm) portion $140K_1$ capable of collapsing or telescoping along its longitudinal axis into the proximal portion $140K_2$ from an extended position (and conversely, extending from the proximal portion $140K_2$ from a collapsed position) to change the length of the spreader 140K. Spreader 140F (and also spreader 140K when moveably coupled), may also be positioned into open positions for drying and closed positions for compact storage, as discussed in greater detail below. Other exemplary types of moveable, fixed, rigid, merged, continuous, flexible or repositionable spreaders 140 are discussed in greater detail below, with such movement or positioning applicable both (1) with respect to the magnetic hub 135, and (2) with respect to or within the spreader 140 itself, such as for articulated, bendable, extendable or collapsible spreaders 140.

In an exemplary embodiment, the first and second suspensions 110, 130 are each molded in a plastic having some flexibility or resiliency, with the magnetic member 120 or magnetic hub 135 each having a respective socket, slot or cavity (such as the socket 165 illustrated for the second suspension 130). Such a socket (165) formed in a resilient or springy material may expand slightly upon insertion of a magnet 125, 145 and then exert pressure to hold the magnet 125, 145 in place. Accordingly, an inserted magnet 125, 145 may be stabilized and held in place through an interlocking fitting, or through friction or pressure from the socket walls of the magnetic member 120 or magnetic hub 135, or held in place using an appropriate cement or glue, for example and without limitation. As illustrated in FIG. 2, a magnet 145 may be inserted into a socket 165 of a magnetic hub 135, and held in place through the interlocking between teeth (or bumps) 170 and corresponding detents (or dimples) 175. Other interlocking arrangements are also equivalent and within the scope of the present invention, such as the rim (or lip) structure 180 illustrated in FIG. 5. While not separately illustrated, identical or similar interlocking, pressure, friction or other stabilizing structures may be utilized to maintain or secure the magnet 125 in a corresponding socket of a magnetic member 120.

The magnets 125, 145 may be comprised of any type of magnetic material, such as a ferromagnet, a plastic or rubber magnet, a ceramic magnet, etc., may have any shape or form (provided that it does not interfere with its magnetic coupling to the other magnet 145, 125), and also may have any selected coating (not separately illustrated), such as a rubber or plastic coating. Depending upon the intended use of the apparatus 100, the magnets 125, 145 may also be provided with a comparatively smooth surface, to avoid puncturing, tearing, or scratching the surface of a secured object 160. In addition, the magnetic member 120, magnetic hub 135 and magnets 125, 145 are generally illustrated herein as substantially having disk shapes, for ease of illustration and explanation. The magnetic member 120, magnetic hub 135, or magnets 125, 145, however, may have innumerable shapes and sizes, including decorative shapes, and all such variations are considered equivalent and within the scope of the present invention.

The second suspension 130 may also optionally include a central shaft (strut or handle) 150, which may be moveably and/or removably attached to the magnetic hub 135, or which may be fixed or integrally formed with the magnetic hub 135, e.g., when also molded in plastic as a single workpiece. In exemplary embodiments, the central shaft 150 may be (1) movable, removable or detachable with respect to the magnetic hub 135 or other location of attachment or coupling to the second suspension 130, and (2) movable with respect to or within the central shaft 150 itself, such as for an articulated, bendable, jointed, flexible, extendable or collapsible central shaft 150, and so on, using any of the mechanisms for movement discussed herein and their equivalents, as may be desired for any selected application. As illustrated in FIG. 2, the central shaft 150 is moveable, having a pivotable articulation (e.g., ball 190 with socket 195), and may have an extended position during use of the second suspension 130 and a folded or closed position for storage of the second suspension 130. In the exemplary embodiment, the central shaft 150 may be utilized to manipulate the second suspension 130 within the object 160, such as to insert the second suspension 130 inside a bag to be held open for drying.

Figure 15:
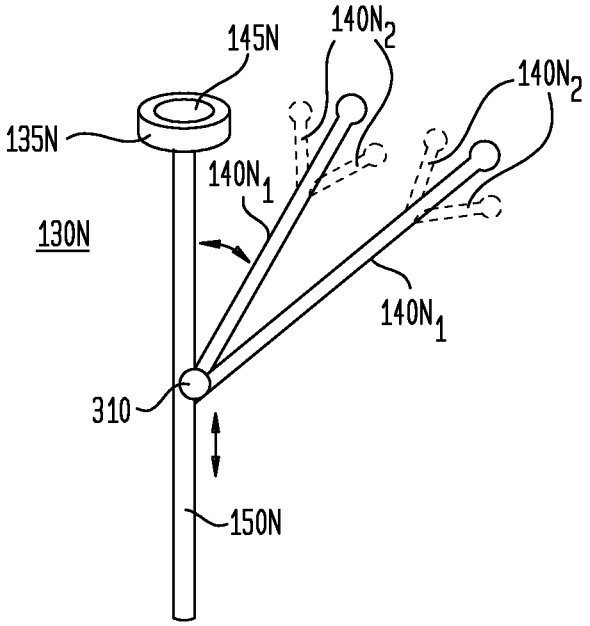
FIG. 15 (or FIG. 15) is a perspective view of a twelfth exemplary second suspension embodiment 130N in accordance with the teachings of the present invention.

As discussed in greater detail below, the plurality of spreaders 140 are coupled to the magnetic hub 135, which may be through a direct attachment or through integrally forming the spreaders 140 with the magnetic hub 135 (as a singular workpiece), or which may be through an indirect attachment of the spreaders 140 via other structures (such as a shaft 150) which are directly coupled to a magnetic hub 135 (as illustrated in FIG. 15). In addition, depending upon the selected embodiment, spreaders 140 may be combined with a magnetic hub 135 in such a way as to be effectively indiscernible as a separate feature or element, as described below. While referred to as "spreaders" 140, it will be understood by those with skill in the art that the spreaders 140 may also be described equivalently using other terminology, such as extensions, arms, annular extensions, elongated arms, struts, shafts, elongated radial members, radial or lateral members, elongated cylindrically-shaped members, etc. In one exemplary embodiment, one or more of the spreaders 140 are attached in a fixed position with respect to the magnetic hub 135, such as when integrally molded with the magnetic hub 135 as a singular workpiece (such as the spreader 140$A_2$ illustrated in FIG. 4, the spreaders 140J illustrated in FIG. 12, or merged spreaders of second suspension 130P illustrated in FIG. 17). In other exemplary embodiments, one or more of the plurality of spreaders 140 are moveably coupled to the magnetic hub 135, such as spreader 140F pivotably coupled through a ball 190 and socket 195 joint (illustrated in FIG. 2), which also may be readily assembled through an interlocking fitting, a "snap fit" or other friction or pressure fitting, with the magnetic hub 135 having suitable mating bores or sockets (illustrated in FIGS. 2, 5 and 9). In yet other exemplary embodiments, at least one spreader 140 or one pair of opposing spreaders 140 are fixed with respect to the magnetic hub 135, while remaining spreaders of the plurality of spreaders 140 are moveably attached to the magnetic hub 135. Also, one or more spreaders 140 may be removably attached to the magnetic hub 135. Accordingly, any combination or permutation of one or more spreaders 140 may be moveable, removable, or fixed (i.e., non-moveable) with respect to the magnetic hub 135, and all such variations are within the scope of the present invention. In addition, any combination or permutation of one or more spreaders 140 may be flexible, articulated, rigid, repositionable, jointed, collapsible, extendable, continuous, merged, hinged, etc., and all such variations are within the scope of the present invention.

The various exemplary embodiments having one or more of the plurality of spreaders 140 moveably coupled to the magnetic hub 135 provide for the second suspension 130 to have a plurality of positions, such as an open position for separating the sides or walls of a suspended object 160 as illustrated in FIG. 1; a closed position, such as for storage of the second suspension 130; and a plurality of positions in between the fully open and fully closed positions, such as for holding open different sizes of objects 160. As used herein, the terms moveable, moveably, moving, and various other forms such as move, motion or movement, mean and include any type or kind of motion, in any spatial dimension and in any orientation, without limitation or restriction as to any corresponding range of motion, including, for example, motions such as pivoting, rotating, sliding, collapsing, extending, inserting, telescoping, swiveling, translating, and so on, and the capability or adaptation for such a corresponding motion, such as pivotable, rotatable, slideable, collapsible, extendable, insertable, telescopeable, swivelable, translatable, etc. For example, a spreader 140 which is capable of moving about a pivot point may also be considered to be capable of pivoting, swiveling, or rotating about the pivot point, such as the spreaders 140F, 140B, 140C, 140D, 140N, 140R (illustrated in FIGS. 2-6, 8, 9, 15, 17). In addition, more than one type of motion may occur concurrently, such as both a sliding and a pivoting motion (spreaders 140$N_1$ of FIG. 15 and spreaders 140L of FIG. 13). Any particular range of motion may also be selectable, and an exemplary or selectable range of motion may be indicated by any corresponding intended use, context, structure or illustrated embodiment. For example, illustrated ball and socket articulations may have a range of motion in all dimensions which is greater than the range of motion of a hinged articulation which allows only turning about a single axis.

The plurality of spreaders 140 and/or second suspension 130 are also sized appropriately for their intended uses. For example, different lengths of the plurality of spreaders 140 may be implemented to correspond to different sizes of bags to be suspended, such as gallon or quart sized bags, e.g., comparatively longer spreaders 140 utilized with comparatively larger bags or other objects 160. In other exemplary embodiments, such as those having flexible, articulated or otherwise bendable spreaders 140, the spreaders 140 may be manipulated by the user to have an effective length or size to fit the corresponding size of the object 160 to be suspended and maintained in an open position. In other exemplary embodiments, different lengths of spreaders 140 may be included within the same second suspension 130, with spreaders 140 of the appropriate length selected by the user, such as by positioning the selected spreaders 140 into an open position, and maintaining the remaining spreaders 140 in a closed position, such as in the second suspension 130F illustrated in FIG. 8 and the second suspension 130G illustrated in FIG. 9.

Any number of spreaders 140 may be utilized in accordance with the present invention, with the selected number typically dependent upon the type of article or object to be supported for drying, and whether the article or object is required to be maintained in an open or fully open position for drying. For example, for supporting a plastic bag in an open position for drying, the exemplary embodiments contemplate use of at least one spreader 140, with four spreaders 140 illustrated in FIG. 1. Similarly, for supporting a plastic wrap or a rubber or leather glove, for example, one or more spreaders 140 may be utilized. An exemplary apparatus for drying a glove, as illustrated in FIG. 11, may comprise from one to five spreaders 140. In addition, in FIGS. 3-5, six spreaders are illustrated, with pairs of corresponding spreaders 140 integrally formed as corresponding singular units and moveable (e.g., rotatable, pivotable or swivelable) about a central axis. In that exemplary embodiment, not all the spreaders 140 are required to be utilized by positioning them into an open position of the apparatus, and some spreaders 140 may be selectively maintained in a closed position. In addition, while not separately illustrated for drying larger objects 160, the second suspension 130 may have multiple groups of spreaders 140, all of which are coupled to the magnetic hub 135, as discussed in greater detail below with reference to FIGS. 11 and 15.

Continuing to refer to FIG. 1, the plurality of spreaders 140, when in an open position as illustrated in this exemplary embodiment, are spaced-apart and extend substantially radially from the magnetic hub 135, to hold an object 160 (such as the illustrated bag) in an open position for drying. While illustrated as substantially extending in the plane of the magnetic hub 135, the plurality of spreaders 140 may also extend at other angles with respect to the magnetic hub 135, such as 30 or 45 degree angles below the plane of the magnetic hub 135, for example, or at various angles above the plane of the magnetic hub 135 (provided such angles do not interfere with the magnetic coupling with the first suspension 110). Many types of spreaders 140 may be utilized, such as flexible spreaders, articulated spreaders, rigid spreaders, fixed spreaders, repositionable spreaders, merged or continuous spreaders, jointed spreaders, or hinged spreaders, as discussed in greater detail below.

While the plurality of spreaders 140 are illustrated as spaced-apart and substantially elongated and generally symmetrical, other shapes and designs of spreaders 140 are also considered equivalent and within the scope of the present invention, such as the exemplary spreader 140 designs illustrated in FIGS. 12, 13, 14 and 17, and other forms and shapes of spreaders, including shapes such as a fork, a "T", a comb, a rake, an ellipse, a square, a triangle, a rectangle, an open frame, a continuous disk, etc. Similarly, non-elongated, asymmetrical, and/or non-radial spreaders may be implemented. It should also be noted that the various spreaders 140 also may be continuous or merged with each other and with the magnetic hub 135, particularly when integrally formed, as illustrated for second suspension 130P in FIG. 17. For example, second suspension 130P may be implemented as a disk or ellipsoid, having a singular, continuous, annular-shaped spreader 140 (or, equivalently, a plurality of continuous and merged spreaders 140) surrounding and extending in all directions from the magnetic hub 135, and further may be implemented with voids or openings (250), or protrusions or dimples (255) provided in the annular-shaped spreader 140 to allow sufficient airflow to the object for drying.

Referring again to FIG. 1, depending upon the selected type of object 160 for passive drying, each spreader 140 of the plurality of spreaders 140 may have a substantially puncture-resistant termination 155, i.e., a termination 155 that does not tend to cause punctures or tears in the object 160. In some exemplary embodiments, a puncture-resistant termination 155 may be implemented through a comparatively larger circumference and substantially smooth and curved surface of the termination 155 (as illustrated in FIGS. 1, 6-9, 11, 15 and 16). In other exemplary embodiments, the "smooth and curved" surface of the puncture-resistant termination 155 may simply consist in not having a significant discontinuity, such as a sharp edge or point (as illustrated in FIGS. 3-5, 12, and 14). For example, for use for suspending plastic bags for evaporative drying, the exemplary embodiments provide for the terminations 155 to have smooth and curved surfaces, with sufficient surface area (from the larger circumference) to avoid puncturing and ruining the bag, with all of the illustrated terminations 155 being considered sufficiently puncture-resistant for this application. The terminations 155 may have any of myriad shapes, such as spherical, ellipsoid, flat, curved, etc., and are illustrated as spherical/ellipsoids in FIG. 1, and as substantially flat and curved in FIGS. 3-5.

Figure 4:
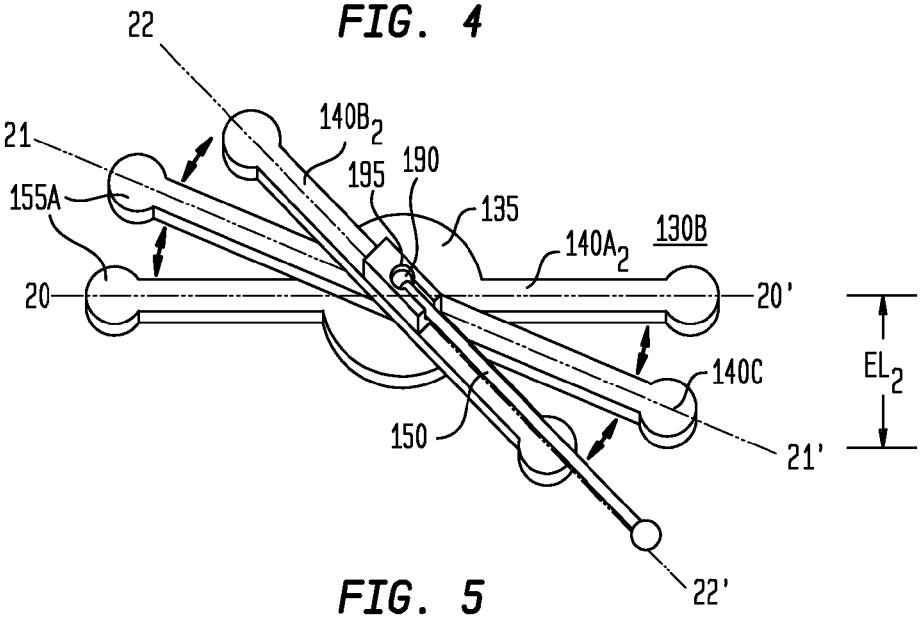
FIG. 4 (or FIG. 4) is a perspective view of a third exemplary second suspension embodiment 130B having a plurality of spreaders 140 of different lengths and in a partially closed position in accordance with the teachings of the present invention.
Figure 5:
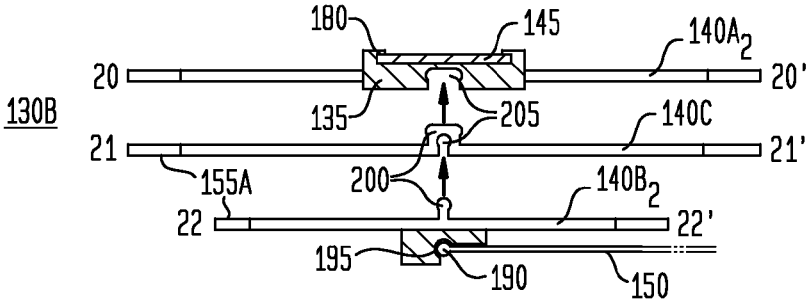
FIG. 5 (or FIG. 5) is a cross-sectional and exploded view of a third exemplary second suspension embodiment 130B having a plurality of spreaders 140 in accordance with the teachings of the present invention.
Figure 8:
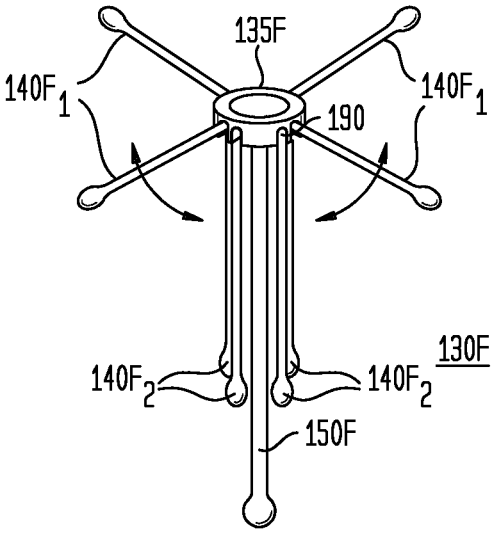
FIG. 8 (or FIG. 8) is a perspective view of a sixth exemplary second suspension embodiment 130F having a plurality of spreaders 140$F_1$ and 140$F_2$ of different lengths and in open and closed positions in accordance with the teachings of the present invention.
Figure 9:
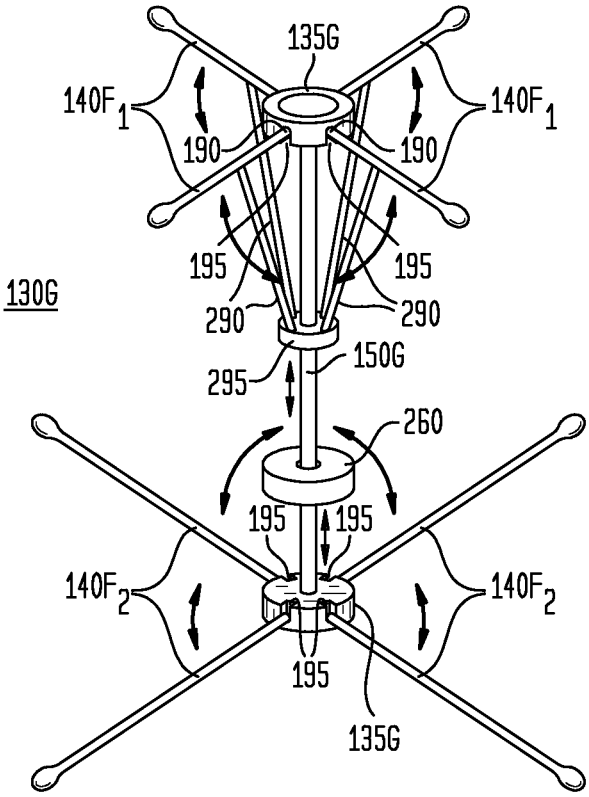
FIG. 9 (or FIG. 9) is a perspective view of a seventh exemplary second suspension embodiment 130G having a plurality of magnetic hubs 135G and a plurality of spreaders 140$F_1$ and 140$F_2$ of different lengths and in open positions in accordance with the teachings of the present invention.

As mentioned above, the optional central shaft 150 may be utilized to insert and manipulate the second suspension 130 within the object 160, such as a wet storage bag, allowing the user's hands to stay dry. When the second suspension 130 does not include the optional central shaft 150, the second suspension 130 may be dropped or placed into the object 160, such as dropped into the bottom of a plastic bag, followed by magnetic coupling to the first suspension 110 and inverting the apparatus 100 with the suspended object 160 into an upright position (as illustrated), for suspension of the apparatus 100 from an external support. In addition, the central shaft 150 may be fixed to, moveably or removably coupled within the second suspension 130, such as to the magnetic hub 135 (as illustrated in FIGS. 1, 2, 8, 9, 13, 15 and 17), to one or more of the spreaders 140 (as illustrated in FIGS. 4, 5, and 14), to another central hub (225, as illustrated in FIG. 11), and may be positioned symmetrically or asymmetrically (offset) within the second suspension 130. Also as illustrated in the various drawings, in exemplary embodiments, the central shaft 150 may be moveable to have an open position (e.g., illustrated in FIGS. 1 and 2) and a closed or folded position (e.g., illustrated in FIGS. 3 and 4). In other exemplary embodiments, the central shaft 150 may be non-moveable; as illustrated in FIGS. 8 and 9, however, because of the orientation of the fixed (or removable) central shaft 150 with respect to the spreaders 140, the second suspension 130 also has both open and closed positions, as illustrated.

The first suspension 110 and the second suspension 130 may be made from any appropriate or suitable materials as may be known or become known, without limitation, such as plastic, wood, metal, wire, fiberglass, architectural fabric, cork, rubber, ceramics, bamboo, coated paper, etc. For durability, exemplary first and the second suspensions 110, 130 are comprised of a material which generally does not corrode or deteriorate in a damp environment. In exemplary embodiments, each of the first suspension 110 and second suspension 130 may be integrally formed as singular workpieces, providing for ease of manufacture, such as through plastic injection molding. In other exemplary embodiments, for example, the magnetic hub 135 may be integrally or monolithically formed, alone or with one or more fixed spreaders, followed by insertion of all or additional spreaders 140 and/or a central shaft 150. In addition, when formed from flexible wire or other material which may rust or degrade from environmental exposure, the magnetic hub 135 and spreaders 140 may also be coated, such as having a plastic or rubber coating.

As may be apparent from the discussion above, the apparatus 100 has innumerable advantages. The exemplary apparatus 100 is adapted to suspend an object 160 from any suitable support, while simultaneously holding the object in an open position for drying, and without requiring user involvement in the drying process. The exemplary apparatus 100 does not require any type of base or other support from below, and does not utilize scarce counter space (although such a base may be available as an option, as illustrated in FIGS. 10 and 17). The exemplary apparatus 100 has very few parts, and each of the first and second suspensions 110, 130 may be integrally formed, followed by ready insertion of corresponding magnets 125, 145. In addition, the various spreaders 140 of the exemplary apparatus 100 may be selectively repositionable, as discussed below, with yet additional advantages.

Figure 3:
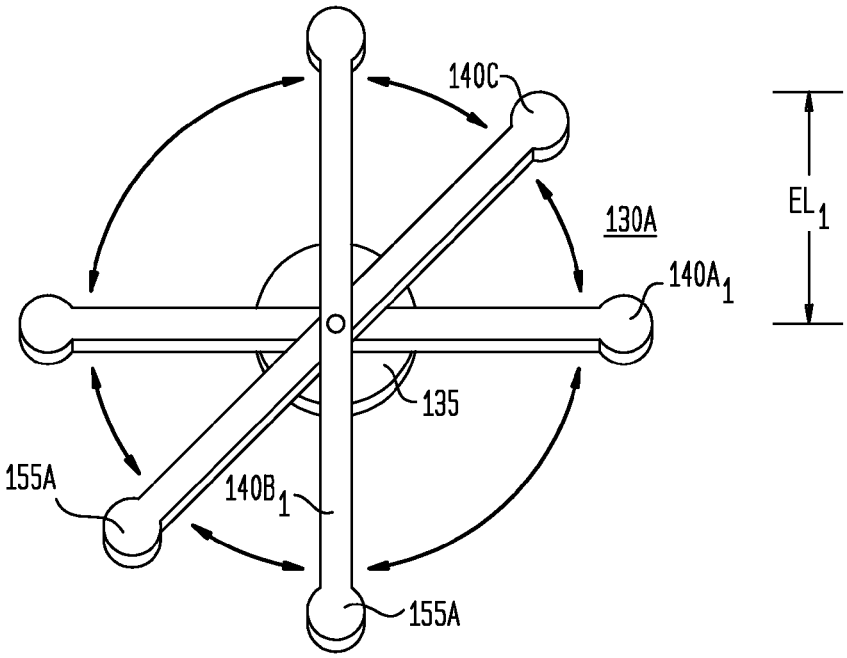
FIG. 3 (or FIG. 3) is a perspective view of a second exemplary second suspension embodiment 130A having a plurality of spreaders 140 in an open position in accordance with the teachings of the present invention.

FIG. 3 is a perspective view of the underside (or bottom) of a second exemplary second suspension embodiment 130A having a plurality of spreaders 140 in an open position in accordance with the teachings of the present invention. FIG. 4 is a perspective view of the underside (or bottom) of a third exemplary second suspension embodiment 130B having a plurality of spreaders 140 of different lengths and in a partially closed position in accordance with the teachings of the present invention. As illustrated, the second suspension embodiment 130A has a plurality of moveable spreaders 140$A_1$, 140$B_1$ and 140C, illustrated in an open position, and all being moveable (e.g., pivotable, rotatable, or swivelable) with respect to the magnet hub 135. In contrast, the second suspension embodiment 130B has a fixed spreader 140$A_2$ integrally formed with the magnet hub 135 and a plurality of moveable spreaders 140$B_2$ and 140C (e.g., pivotable, rotatable, or swivelable with respect to the magnet hub 135), illustrated in a partially closed position, and with spreader 140$B_2$ comparatively shorter in length than spreader 140C or integrally formed spreader 140$A_2$. In addition, the second suspension embodiment 130B has a moveable central shaft 150 (illustrated in a closed or compact position) coupled to the spreader 140$B_2$ through any of a plurality of types of articulations, for example, through a ball and socket articulation 190, 195. In an exemplary embodiment, the socket 195 is integrally formed with the spreader 140$B_2$.

FIG. 5 is a cross-sectional and exploded view (through the 20-20', 21-21', and 22-22' planes) of the third exemplary second suspension embodiment 130B (in an upright position) having the integrally formed fixed spreader 140$A_2$, the moveable spreaders 140$B_2$ and 140C, and the moveable central shaft 150, illustrated separately and prior to insertion of spreaders 140$B_2$ and 140C into the magnetic hub 135. The second suspension embodiment 130B may be readily assembled by corresponding insertion of the interlocking (or ball) portion 200 of the fittings of spreaders 140$B_2$ and 140C into the corresponding or mating sockets 205 of spreader 140C and magnetic hub 135, as indicated in FIG. 5. In addition, the magnet 145 may be inserted into a corresponding socket of the magnetic hub 135, and held in place through the rim (or lip) structure 180, as previously discussed. Although not separately illustrated, the second suspension embodiment 130A may be formed similarly, with the moveable spreader 140$A_1$ having a fitting which is also insertable into a corresponding socket of the magnet hub 135.

As illustrated for second suspension embodiment 130A, the plurality of spreaders 140$A_1$, 140$B_1$ and 140C are moveable (pivotable or rotatable) about an axis substantially normal (perpendicular) to the plane of the magnetic hub 135, to any angle or orientation (indicated by the movement arrows). Also as illustrated for second suspension embodiment 130B, the fixed spreader 140$A_2$ is formed integrally with the magnetic hub 135, and the plurality of spreaders 140$B_2$ and 140C are moveable (pivotable or rotatable) about an axis substantially normal (perpendicular) to the plane of the magnetic hub 135 with integrally formed fixed spreader 140$A_2$, also to any angle or orientation (and indicated by the movement arrows). (It should be noted that the plurality of spreaders 140A, 140B and 140C may each be viewed equivalently as a pairs of corresponding spreaders 140A, 140B and 140C, with each pair formed as a singular unit.) In exemplary embodiments, the plurality of spreaders 140$A_1$, 140$B_1$ and 140C, or 140$B_2$ and 140C, are repositionable by the user with respect to the magnetic hub 135, and maintainable in a selected position through resistance (i.e., frictional forces) exerted within the rotatable or pivotable coupling (such as the illustrated interlocking, pivotable or rotatable joints or fittings 200, 205). For example, the spreaders 140 may be formed to have sufficiently tight fittings 200, 205 to be maintainable in a selected position until repositioned by the user, or may have a mechanism capable of being selectively tightened (not separately illustrated), such as a screw, a thumbscrew or a clamp, to lock or hold the spreaders 140 in a selected position. Those having skill in the art will recognize that innumerable types of moveable fittings 200, 205 may be utilized equivalently and are within the scope of the present invention, such as the pivotable, releasable, repositionable and stable fittings disclosed in Milner et al. U.S. Pat. No. 5,172,534 issued Dec. 22, 1992, incorporated herein by reference.

In addition, while six spreaders are illustrated in FIGS. 3-5, with pairs of corresponding spreaders 140 integrally formed and moveable about a central axis, more or fewer spreaders 140 may be utilized equivalently. In addition, not all the spreaders 140 are required to be utilized by positioning them into an open position of the apparatus, with some spreaders 140 being selectively maintained in a closed position. While the spreaders 140$A_1$, 140$B_1$ and 140C are illustrated as having the same length in FIG. 3, different lengths of spreaders

140$A_2$, 140$B_2$ and 140C may also be utilized, as illustrated in FIGS. 4 and 5. This is especially appropriate for utilizing a single second suspension embodiment 130B for drying different sized objects 160 and maintaining the object 160 in an open position. For example, when the pairs of corresponding spreaders 140 have different lengths, first, a shorter pair of spreaders 140$B_2$ may be placed in an open position for drying smaller bags, with a longer pair of spreaders 140C maintained in a closed position; and second, a longer pair of spreaders 140C may be placed in an open position for drying larger bags, with a shorter pair of spreaders 140$B_2$ maintained in either an open or a closed position. In addition, depending upon the selected lengths of the spreaders 140A, 140B and 140C, and depending upon the selected fittings 200, 205, the corresponding terminations 155 may have shapes in addition to the curved, flat shapes illustrated, such as spherical or ellipsoid shapes, provided the terminations 155 do not interfere with spreaders 140A, 140B and 140C of the second suspension 130A or 130B being positioned into a sufficiently closed position suitable for storage.

The second suspension embodiments 130A and 130B have particular advantages. First, in a closed position, the second suspension embodiments 130A and 130B are slim and compact, providing for ease of storage in a typical drawer when not in use, occupying the equivalent space of a typical utensil, such as a spoon or fork. Second, the plurality of moveable spreaders 140$A_1$, 140$B_1$ and 140C, or 140$B_2$ and 140C, may be selectively positioned by the user, such as to accommodate objects of different sizes for drying. For example, a user may position the plurality of spreaders 140$A_1$, 140$B_1$ and 140C, or 140$B_2$ and 140C, into a fully open position for larger objects, such as gallon-sized bags, reposition the spreaders 140$A_1$, 140$B_1$ and 140C, or 140$B_2$ and 140C, into a partially open position for comparatively smaller objects, such as quart-sized bags, and reposition the spreaders 140$A_1$, 140$B_1$ and 140C, or 140$B_2$ and 140C, into a fully closed position for storage. Such repositioning, as illustrated, modifies an "effective length" of the spreaders 140$A_1$, 140$B_1$ and 140C, or 140$B_2$ and 140C, i.e., the degree to which the length of the spreaders 140$A_1$, 140$B_1$ and 140C, or 140$B_2$ and 140C, may be utilized to extend and maintain an object 160 in an open position. As illustrated, the spreader 140C has a comparatively longer effective length in a fully open position (abbreviated as "EL" and illustrated as $EL_1$ in FIG. 3), and a comparatively shorter effective length in a more closed position (illustrated as $EL_2$ in FIG. 4).

Figure 6:
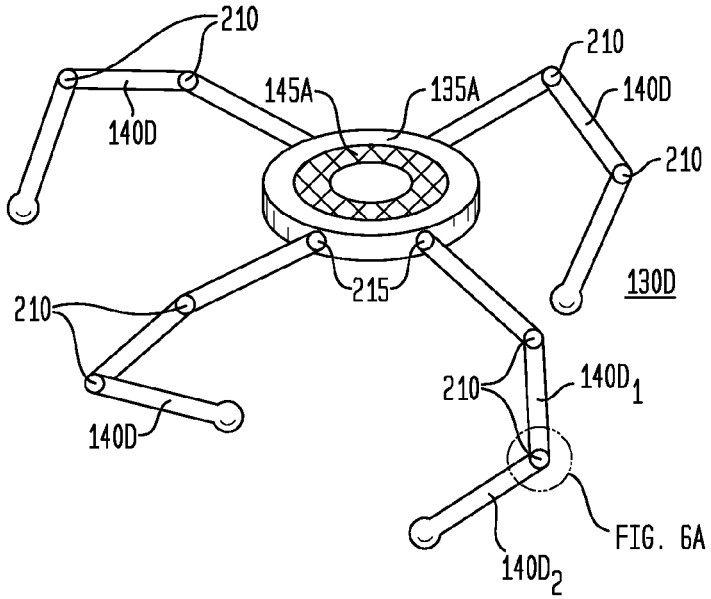
FIG. 6 (or FIG. 6) is a perspective view of a fourth exemplary second suspension embodiment 130D having a plurality of spreaders 140D in accordance with the teachings of the present invention.

FIG. 6 is a perspective view of a fourth exemplary second suspension embodiment 130D having a plurality of spreaders 140D in accordance with the teachings of the present invention. The spreaders 140D are articulated (jointed or hinged), illustrated as corresponding repositionable articulations 210, and may also include repositionable articulations or other repositionable couplings 215 where the spreaders 140D join the magnetic hub 135A. While illustrated as having multiple articulations 210 in each spreader 140D, it should be noted that the plurality of spreaders 140D of the second suspension embodiment 130D may each have any selected number of repositionable articulations 210 or couplings 215, to provide for any selected variety of user-manipulable shapes of the second suspension embodiment 130D.

Figure 6A:
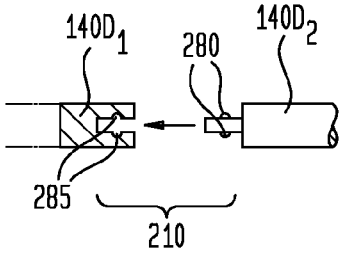
FIG. 6A (or FIG. 6A) is a detailed and exploded view of an exemplary articulation 210 of an exemplary spreader in accordance with the teachings of the present invention.

The articulations 210 and couplings 215 may be implemented as known in the mechanical arts, such as through typical joints, fittings, hinges which may be molded in plastic, rubber, or other materials, without limitation, e.g., the pivotable attachments disclosed in U.S. Pat. No. 5,172,534. FIG. 6A is a detailed and exploded view of an exemplary articulation 210 of an exemplary articulated spreader 140D in accordance with the teachings of the present invention. As illustrated, an exemplary articulation 210 may be comprised of a spherical protrusion (or bump) 280 which moveably (e.g., rotatably or pivotably) couples with a mating socket (or dimple) 285, allowing pivoting of each segment of the spreader 140D with respect to another segment, illustrated as segments 140$D_1$ and 140$D_2$.

In addition, the articulations 210 and couplings 215 may be of different types. For example, the couplings 215 may be embodied as ball and socket joints, for movement and positioning in many directions, while the articulations 210 may be embodied utilizing a joint or hinge structure, for movement and repositioning in a selected plane of the spreader 140D. In this second suspension embodiment 130D, the plurality of spreaders 140D also may be selectively positioned and repositioned by the user, and maintainable in a selected position through resistance (i.e., frictional forces) exerted at or interlocking with the articulations 210 and couplings 215, such as to accommodate objects of different sizes for drying. Such repositioning also modifies an effective length of the spreaders 140D, with a greater degree of bending at an articulation 210, 215 resulting in a comparatively shorter effective length and a more closed position of the second suspension embodiment 130D (illustrated in FIG. 7 for second suspension embodiment 130E). In addition, following drying of the object 160, the plurality of spreaders 140D (and 140E, discussed below) may be repositioned to maintain the second suspension embodiment 130D in flat or curled positions, based on user preference, such as fully opened into a flat position or curled into a compact ball for storage.

Figure 7:
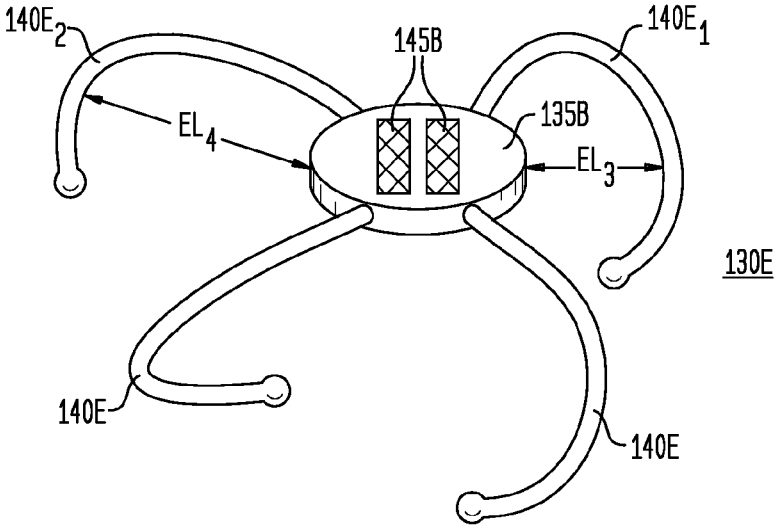
FIG. 7 (or FIG. 7) is a perspective view of a fifth exemplary second suspension embodiment 130E having a plurality of spreaders 140E in accordance with the teachings of the present invention.

FIG. 7 is a perspective view of a fifth exemplary second suspension embodiment 130E having a plurality of spreaders 140E in accordance with the teachings of the present invention. In this exemplary embodiment, each of the spreaders 140E is flexible, and may be selectively positioned and repositioned by the user into innumerable positions and in any direction by selective deformation or bending in any location along the length of a spreader 140E. For example, the plurality of spreaders 140E may be implemented as bendable coated wires or bendable plastics or rubber. Once positioned or repositioned by the user, the position of the plurality of spreaders 140E is inherently maintained by the material comprising the spreaders 140E (subject to application or reapplication of other forces, such as deformation from holding open an overly heavy object 160 or repositioning by the user). For ease of manufacture, when the second suspension embodiment 130E is comprised of wire, the entire second suspension embodiment 130E (including the magnets 145B) may then be coated to be impervious to environmental elements, such as to prevent rusting.

FIGS. 6 and 7 also illustrate different types of exemplary magnetic hubs 135 and magnets 145 which may be utilized equivalently, illustrated as magnetic hubs 135A and 135B having corresponding magnets 145A and 145B. As illustrated, magnetic hub 135A includes an annular magnet 145A, while magnetic hub 135B includes a plurality of rectangular magnets 145B. Such variations may also be utilized within the magnetic member 120 of the first suspension 110, and all such variations are considered equivalent and within the scope of the present invention.

FIGS. 6 and 7 further illustrate the manipulability of the spreaders 140D and 140E in virtually any direction or plane with respect to the magnetic hubs 135A and 135B, respectively, and to have any effective length for accommodating different sizes and shapes of objects 160. For example, by manipulating the articulations 210, 215 or by bending a spreader 140E, to position the spreader 140D, 140E in more curled and closed orientation, the effective length of the spreader 140D, 140E is shortened, to accommodate comparatively smaller objects. As illustrated, the spreader 140$E_1$ has a comparatively shorter effective length in a more curled and closed position (illustrated as $EL_3$), while spreader 140$E_2$ has a comparatively longer effective length in a less curled and more open position (illustrated as $EL_4$). (For other embodiments, orienting the spreaders (140F, 140B, 140C) at different angles to the magnetic hub 135 to form partially open positions, either laterally (in the plane of the magnetic hub 135 as in FIGS. 3 and 4) or vertically (below the plane of the magnetic hub 135 as in FIG. 8 for spreaders 140$F_2$), also has the effect of changing the effective length of the spreaders, such that partially open positions may accommodate smaller objects.) Such manipulability of the pluralities of spreaders 140D and 140E further enables the apparatus 100 to be utilized for the drying of innumerable objects, such as bags, gloves, hats, caps, socks, mittens, shorts, Lycra™ or other elastic materials and fabrics, flexible wrappings, or any other flexible object which would otherwise be incapable of being either self-supporting or in an open position when wet.

FIG. 8 is a perspective view of a sixth exemplary second suspension embodiment 130F having a plurality of spreaders 140$F_1$ and 140$F_2$ of different lengths and in open and closed positions, respectively, in accordance with the teachings of the present invention. FIG. 9 is a perspective view of a seventh exemplary second suspension embodiment 130G having a plurality of magnetic hubs 135G and a plurality of spreaders 140$F_1$ and 140$F_2$, also of different lengths and in open positions in accordance with the teachings of the present invention. The plurality of spreaders 140$F_1$ and 140$F_2$ are articulated (jointed or hinged) and repositionable where the plurality of spreaders 140$F_1$ and 140$F_2$ join the magnetic hubs 135F, 135G, illustrated in the exemplary second suspension embodiments 130F and 130G as ball joints 190 which are insertable into corresponding sockets (or slots) 195 (illustrated for the magnetic hubs 135G). The articulations may be of any type or kind, such as the illustrated ball and socket joints 190, 195, may be implemented as known in the mechanical arts, as discussed above, and may be molded in plastic, rubber, or other materials. The plurality of spreaders 140$F_1$ and 140$F_2$ may be rigid, articulated or flexible, as previously discussed for other embodiments.

Also as illustrated, the second suspension embodiment 130F further includes a non-moveable (or fixed) central shaft 150F, which is oriented in the same direction as the plurality of spreaders when in a closed position (spreaders 140$F_2$) and substantially perpendicular to the plurality of spreaders when in a fully open position (spreaders 140$F_1$). The central shaft 150F also may be removably or moveably couplable to the magnetic hub 135F (or 135G) (e.g., once a removable central shaft 150F is inserted into the magnetic hub 135F, the central shaft 150F may be either moveable or non-moveable). In this second suspension embodiment 130F, the plurality of spreaders 140$F_1$ and 140$F_2$ also may be selectively positioned and repositioned by the user, and maintainable in a selected position through resistance (i.e., frictional forces) or interlocking at the articulations 190, 195. A user may select one or more of the spreaders 140$F_1$ and 140$F_2$ having different lengths, and may reposition them between open and closed positions, to accommodate different sized objects 160, as previously discussed. A particular advantage of this second suspension embodiment 130F is its simplicity, allowing use of comparatively simpler spreaders 140$F_1$ and 140$F_2$, while concurrently providing for a plurality of open and closed positions, such as for storage or for supporting different sized objects, and providing ease of manufacture, such that the plurality of spreaders 140$F_1$ and 140$F_2$ may be simply inserted into the magnetic hub 135F.

Referring to FIG. 9, the second suspension embodiment 130G comprises a plurality of magnetic hubs 135G, each having a corresponding plurality of spreaders 140$F_1$ and 140$F_2$ of different lengths. The two illustrated magnetic hubs 135G are spaced-apart and coupled to each other via a fixed central shaft 150G. In this second suspension embodiment 130G, the corresponding pluralities of spreaders 140$F_1$ and 140$F_2$ also have different sizes (lengths), for correspondingly supporting objects of different sizes during the drying process. In operation, a user selects the magnetic hub 135 having the appropriately sized plurality of spreaders 140$F_1$ and 140$F_2$ for supporting the selected object and coupling to a first suspension 110, with the other magnetic hub 135 (and spreaders 140$F_1$ or 140$F_2$) typically remaining unused (or utilized for the series couplings of second suspensions 130 as illustrated in FIG. 17).

As an additional option, the second suspension embodiment 130G also comprises a plurality of struts 290, moveably coupled to the spreaders 140$F_1$ and to a ring structure (or ring) 295, with the ring structure 295 being moveable (i.e., slideable) along the central shaft 150G, to provide for an umbrella-like opening and closing of the spreaders 140$F_1$. The ring structure 295 may be positioned along the central shaft 150G by a user, to correspondingly and concurrently move (via struts 290) the spreaders 140$F_1$ into open, partially open and closed positions. The ring structure 295 may be maintained in a selected position through resistance (i.e., frictional forces) or through any of a plurality of interlocking mechanisms (not separately illustrated) along the central shaft 150G. In general, to allow the umbrella-like movement, the plurality of struts 290 are moveably coupled to the first plurality of spreaders, such as through hinge or joint articulations (not separately illustrated), and the ring structure 295 is also moveably coupled to the plurality of struts, such as through hinge or joint articulations (also not separately illustrated), and slideably coupled to the central shaft.

Also as illustrated in FIG. 9, the second suspension embodiment 130G further comprises a third, annular magnetic structure 260 (e.g., an annular-shaped magnet), which is slideable along the central shaft 150G and which is utilized to lock or hold the spreaders 140$F_2$ into an open position. More particularly, when the spreaders 140$F_2$ are manipulated into an open position, the third magnetic structure 260 may be slid along the central shaft 150G to abut the magnetic hub 135G. The magnetic structure 260 is held in place via magnetic coupling with the magnetic hub 135G and, in turn, prevents the spreaders 140$F_2$ from folding back into a closed position and thereby maintains the spreaders 140$F_2$ in an open position.

FIG. 10 is a perspective view of a seventh exemplary first suspension embodiment 110J in accordance with the teachings of the present invention. In this exemplary embodiment, the first suspension 110J further comprises corresponding pluralities of magnetic members 120F, for magnetic coupling with a corresponding plurality of second suspensions 130. The magnetic members 120F are spaced-apart and coupled to each other and to the suspending member 115 (illustrated as exemplary suspending member 115A) by one or more supporting beams or rods 220. The supporting beams or rods 220 may also be moveable with respect to each other, such as to pivot or rotate between an open position for use and a closed position for storage. Using such an exemplary embodiment, a single first suspension 110J may be utilized to simultaneously support a plurality of objects 160, held between the first suspension embodiment 110J and a corresponding plurality of second suspension embodiments 130, and then suspended by the first suspension embodiment 110J from an external support at a single location. Alternatively, for a larger object, a plurality of second suspensions 130 may be inserted inside the object, and the first suspension 110J utilized to magnetically couple to each of the inserted second suspensions 130 to support one or more larger objects 160. Again, the exemplary first suspension embodiments having a plurality of magnetic members 120 may have innumerable shapes and forms, along with any selected number of magnetic members 120. For example, a first suspension embodiment having two magnetic members 120 is readily suited to support drying of a pair of gloves, as discussed below.

This exemplary first suspension embodiment 110J is also suited for use with an optional supporting base 115J, as a type of suspending member 115 within the scope of the present invention, for support of the apparatus from below. Such a supporting base type of suspending member 115J may have any form or configuration, without limitation, such as sized and shaped for stability when the first suspension embodiment 110J is fully occupied with objects 160 for drying. The optional supporting base type of suspending member 115J also may be removable or articulated where the base 115J joins the supporting beams or rods 220 (e.g., articulations 190, 195, 210 or 215 as illustrated), such as for folding or otherwise repositioning the first suspension embodiment 110J into a closed position for storage. In exemplary embodiments, the supporting base type of suspending member 115J may be (1) movable, removable or detachable with respect to the location of attachment or coupling to the other components of a first suspension 110, and (2) movable with respect to or within the supporting base type of suspending member 115J itself, such as for an articulated, bendable, jointed, flexible, extendable or collapsible supporting base, and so on, using any of the mechanisms for movement discussed herein and their equivalents, as may be desired for any selected application (e.g., for supporting the apparatus 100 with a secured object 160 at any of various angles with respect to an external support, such as a counter).

FIG. 11 is a perspective view of a second exemplary apparatus embodiment 100H with an eighth exemplary first suspension embodiment 110D and an eighth exemplary second suspension embodiment 130H, and further illustrates the versatility of the embodiments of the present invention, such as for passive drying of a glove or similarly shaped object. In this apparatus embodiment 100H, a first magnetic hub 135H is coupled to a first spreader 140H as illustrated, which is further coupled to a second hub 225 (which generally is not magnetic). The second hub 225 is further coupled to additional spreaders 140H, each of which may be utilized to separately support a finger or thumb portion of a glove (object 160H), for example, or another object 160 having flexible components which may require separate and independent support for drying. While illustrated with five spreaders 140H, fewer spreaders 140H may also be utilized; for example, the object 160H may be supported through the magnetic hub 135H attached to the one, first spreader 140H (which may then also function additionally as a central shaft). The plurality of spreaders 140H, in the exemplary embodiment 100H, are either fixed or joined through articulations 240 to the second hub 225, which may be any of the types of moveable articulations discussed herein, to more readily allow for insertion of the second suspension 130H into the glove (object 160H), further allowing use of a single second suspension embodiment 130H to dry different sized gloves (e.g., children's, adults', etc.), and further allowing for a closed position for storage of the device. In this apparatus embodiment 100H, the plurality of spreaders extend radially from the same side of the second hub 225 in a span of less than about 180 degrees, as illustrated.

The magnetic hub 135H portion of the second suspension 130H provides for magnetic coupling to a first suspension 110, illustrated as eighth exemplary first suspension embodiment 110D having a rigid ring (closed hook or loop) structure for the suspending member 115D. FIG. 11 further illustrates the use of a first suspension 110 to provide suspension of the apparatus 100 from an exemplary external support. As illustrated, the exemplary external support is a knob or handle 270 attached to a cabinet 275, such as an overhead cabinet found in a typical kitchen. As discussed above, innumerable types of external supports may be utilized and are equivalent, such as curtain rods, shelves or shelf supports, etc.

FIG. 11 also illustrates another configuration of a second suspension 130, in which a magnetic hub 135H is coupled to a spreader 140H, which is further coupled to second hub 225 having a plurality of spreaders 140H. For example, for supporting a larger object, while not separately illustrated, two second suspensions 130H may be combined into a single unit. For this embodiment, a single, first magnetic hub 135H is coupled to two or more spreaders 140H, each of which is then further separately coupled to a corresponding second hub 225. The corresponding plurality of second hubs 225 are each then coupled to additional pluralities of spreaders 140H, potentially resulting in a stronger or more stable second suspension 130 for supporting larger objects 160.

Figure 12:
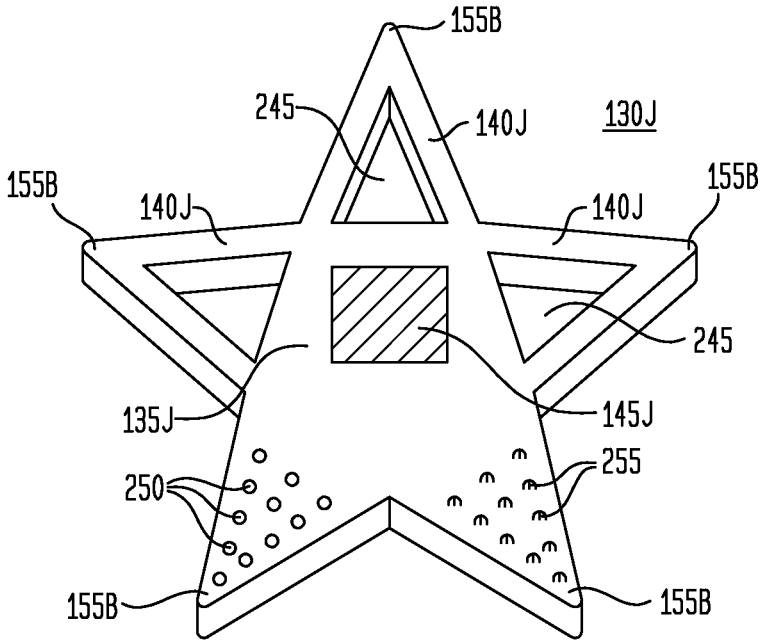
FIG. 12 (or FIG. 12) is a perspective view of a ninth exemplary second suspension embodiment 130J in accordance with the teachings of the present invention.

FIG. 12 is a perspective view of a ninth exemplary second suspension embodiment 130J in accordance with the teachings of the present invention. As illustrated, the second suspension embodiment 130J may have a decorative form, such as a star, flower or other fanciful shape, illustrated with a plurality of spreaders 140J coupled to or integrally formed with magnetic hub 135J (with corresponding magnet 145J). To improve air flow around the pluralities of spreaders 140J and an object 160, voids or openings 245 may also be included within each of the spreaders 140J. In addition and alternatively, cavities or dimples 250 or raised bumps or protrusions 255 may also be utilized to decrease contact between the spreaders 140J and the surface of any supported object, to improve drying performance.

As previously mentioned, a second suspension 130 may be implemented in virtually any shape or form, and depending upon that shape, spreader(s) 140 may be effectively continuous and indistinguishable from the magnetic hub 135 portion of the second suspension 130, as illustrated by second suspension embodiment 130P in FIG. 17, having a magnetic hub 135P which includes continuous, merged, or otherwise indistinguishable spreaders. For example, a second suspension 130P may be embodied shaped as a disk as illustrated, (or as an ellipsoid, a square, a triangle, etc.), having a centrally-located magnet 145P. For such an embodiment, the second suspension 130 may be viewed as a magnetic hub 135P integrally formed with a single continuous spreader (or, equivalently, a plurality of continuous and merged spreaders) which surrounds and extends in all directions from the magnetic hub 135P. Alternatively, the second suspension embodiment 130P, or these other various-shaped embodiments of a second suspension 130, for example, may be viewed equivalently as comprising a magnetic hub 135P only, typically having a more extended form (such as a larger disk or second suspension 130P), without being formed with or coupled to any discrete, individuated or otherwise distinguishable spreaders 140. Such embodiments, for improved airflow, generally may also include voids, openings, cavities, dimples, raised bumps or protrusions, as discussed above, such as the openings 250 illustrated in second suspension 130P. These alternatives are considered equivalent and also within the scope of the present invention.

Figure 13:
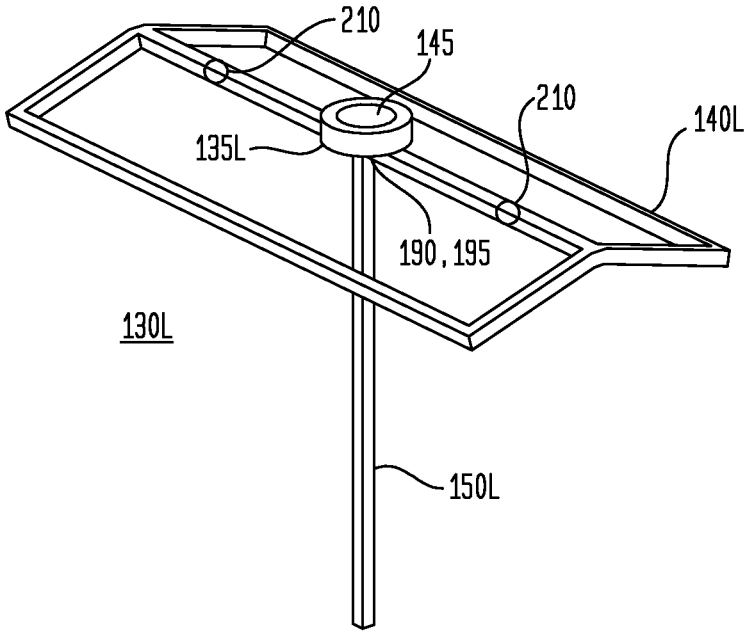
FIG. 13 (or FIG. 13) is a perspective view of a tenth exemplary second suspension embodiment 130L in accordance with the teachings of the present invention.

FIG. 13 is a perspective view of a tenth exemplary second suspension embodiment 130L, and illustrates use of a single spreader 140L which extends at least partially non-radially from a magnetic hub 135L. As illustrated, the single spreader 140L may be hinged or articulated (articulations 210), such as for folding for compact storage. The spreader 140L is a substantially rectangular frame (i.e., a rectangular structure having two large openings or voids as illustrated) and is coupled to the magnetic hub 135L via a crossbar structure. The illustrated second suspension embodiment 130L further comprises an optional central shaft 150L, which also may be removable and/or moveable (such as through a ball and joint 190, 195) for folding for compact storage. Other articulations may be utilized which provide for both folding and rotating, such that the spreaders 140L may be folded, and the folded spreaders 140L may then be aligned with the central shaft 150L for compact storage. Innumerable variations of the single spreader 140L will be readily apparent, such as the rake, comb, "T", disk, ellipsoid, and other structures previously mentioned. In addition, while not separately illustrated, the spreader 140L may also be implemented in a collapsible or telescoping form, also as previously discussed. Equivalently, as discussed above with respect to FIG. 12, the rectangular second suspension embodiment 130L may be viewed as a single, extended magnetic hub 135L having a rectangular form with two large voids or openings which then define the illustrated frame and crossbar structure, and all such variations are within the scope of the present invention.

FIG. 14 is a perspective view of an eleventh exemplary second suspension embodiment 130M, and also illustrates use of a single spreader 140M (having illustrated collapsible portions 140$M_1$ and 140$M_2$). The second suspension embodiment 130M is asymmetric, with spreader 140M extending from one side of a magnetic hub 135M (while the single spreader 140M is symmetric about its longitudinal axis, it extends asymmetrically with respect to the magnetic hub 135M). The magnetic hub 135M further illustrates an embodiment utilizing a surface-mounted magnet 145M. A central shaft 150M is offset from and coupled indirectly to the magnetic hub 135M, and instead is coupled directly to the single spreader 140M. Optionally, the central shaft 150M is also moveable (and may also be removable) with respect to the single spreader 140M (ball and socket articulation 190, 195), such as for folding for compact storage. The spreader 140M has a curved "T" shape (or an anchor shape), illustrating a type of exemplary forked spreader, with distal portion 140$M_1$ collapsible into and extendable from the proximal portion 140$M_2$ for modifying the length of the single spreader 140M.

Figure 16:
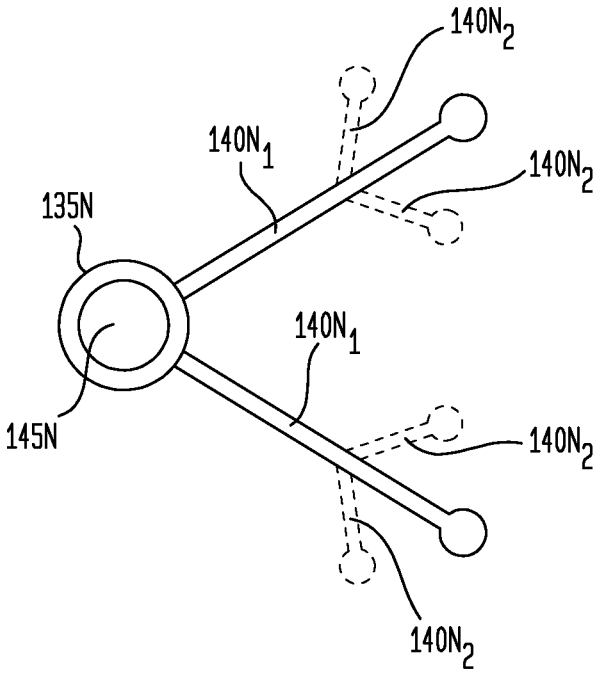
FIG. 16 (or FIG. 16) is a top view of a twelfth exemplary second suspension embodiment 130N in accordance with the teachings of the present invention.

FIG. 15 is a perspective view and FIG. 16 is a top view of a twelfth exemplary second suspension embodiment 130N, and serve to illustrate several variations in accordance with the teachings of the present invention. In this exemplary second suspension embodiment 130N, spreaders 140$N_1$ are coupled indirectly to the magnetic hub 135N. More specifically, the spreaders 140$N_1$ are moveably coupled to a central shaft 150N, through an articulation 310, with the central shaft 150N in turn coupled directly to the magnetic hub 135N. In addition, the second suspension embodiment 130N is partially asymmetric with respect to the magnetic hub 135N, with spreaders 140$N_1$ extending from one side of the central shaft 150N. In this second suspension embodiment 130N, the articulation 310 may be implemented as known in the mechanical arts to provide two types of independent movement, allowing the spreaders 140$N_1$ to pivot toward and away from the central shaft 150N, and allowing the spreaders 140$N_1$ to slide along the central shaft 150N. For example, for a closed position, the spreaders 140$N_1$ can pivot toward and/or slide down the central shaft 150N, and for an open position, the spreaders 140$N_1$ can pivot away from and/or slide up the central shaft 150N.

The second suspension embodiment 130N further illustrates the use of exemplary forked spreaders 140$N_1$, as primary spreaders, which in turn are coupled to (and typically integrally formed with) secondary spreaders, illustrated as secondary spreaders 140$N_2$. Accordingly, the secondary spreaders 140$N_2$ are coupled indirectly to the magnetic hub 135N, via the primary spreaders 140$N_1$ and the central shaft 150N. (As discussed above with respect to FIG. 11, each of the locations where the secondary spreaders 140$N_2$ are coupled to the primary spreaders 140$N_1$ also may be considered central hubs to which are attached (moveably or non-moveably) a plurality of secondary spreaders 140$N_2$.)

It should also be noted that the structure of second suspension embodiment 130N also lends itself to fanciful or artistic embodiments. For example, the magnetic hub 135N may be implemented to be head-shaped, the central shaft 150N may be implemented to be torso-shaped, and the spreaders 140$N_1$ implemented as arms and hands. A variant or combination of second suspension embodiments 130N and 130H is illustrated in FIG. 17, as second suspension embodiment 130R, for use in suspending a glove for drying, as discussed in greater detail below.

FIG. 17 is a perspective view of additional apparatus embodiments, a ninth exemplary first suspension embodiment 110H, and thirteenth and fourteenth exemplary second suspension embodiments 130R, 130P in accordance with the teachings of the present invention. Exemplary apparatus embodiments comprise any combinations of the first suspension 110H with any of the second suspensions 130E, 130P, 130R, and 130Q. As illustrated, the exemplary second suspensions 130E, 130P, 130R, and 130Q each include a corresponding central shaft 150 (central shafts 150E, 150P, 150R, and 150Q, respectively) which is coupled to a second magnetic member 265 (second magnetic members 265E, 265P, 265R, and 265Q, respectively). Each second magnetic member 265 functions similarly to the (first) magnetic member 120, for magnetic coupling to a next second suspension 130 as illustrated, for providing support to a plurality of second suspensions 130 in a "chained" or series-coupled arrangement. For example, as illustrated, securing object 160 (illustrated as a bag), second suspension 130Q is magnetically couplable (through magnetic hub 135Q) to first suspension 110H, and securing object 160P (illustrated as a hat), second suspension 130P is magnetically couplable (via magnetic hub 135P) to second suspension 130Q, through the second magnetic member 265Q, allowing both second suspensions 130Q and 130P to be suspended from the first suspension 110H in a chained or stacked arrangement. Similarly, securing object 160H (illustrated as a glove), second suspension 130R is magnetically couplable (via magnetic hub 135R) to first suspension 110H, and securing object 160E (illustrated as a baseball cap), second suspension 130E is magnetically couplable (via magnetic hub 135E) to second suspension 130R, through the second magnetic member 265R, also allowing both second suspensions 130R and 130E to be suspended from the first suspension 110H in a chained, series or stacked arrangement.

It should be noted that the second magnetic member 265 may have as structure quite similar to one of the second magnetic hubs 135G illustrated in FIG. 9, but does not include any spreaders 140. Accordingly, the second magnetic member 265 may also be considered to be a second magnetic hub 135, and vice-versa, differing only with respect to the inclusion of one or more spreaders 140.

The first suspension 110H also has several novel features and several different functions. First, as a type of suspending member 115, the first suspension 110H utilizes one or more bores or openings 115H, which may have multiple purposes, such as to accommodate fasteners (e.g., screws, nails, not separately illustrated) for mounting or fastening the first suspension 110H to an external support, in any orientation. (In addition, adhesive materials such as glue or cement may also be utilized to mount the first suspension 110H to an external support.) Second, the first suspension 110H also accommodates removable or detachable suspending members 115, such as the illustrated suspending member 115A, which may be removably inserted into one or more bores or openings 115H (as another potential use of the bores or openings 115H). This feature further allows individual selection and insertion of the type of suspending member 115 for use with any corresponding type of external support.

Third, the first suspension 110H may also be inverted to form a magnetic base-type of supporting structure, to support one or more second suspensions 130 (either singularly or in a series or stacked arrangement) from below, via magnetic coupling with corresponding second magnetic members 265, also as illustrated in FIG. 17. For example, via a second magnetic member 265E, second suspension 130E is magnetically couplable (from below) to the inverted first suspension 110H, and while securing object 160E (e.g., a baseball cap), the second suspension 130E is magnetically couplable (through magnetic hub 135E) to second suspension 130R, via second magnetic member 265R, thereby supporting second suspension 130R from below. In this configuration, the second suspension 130R may be holding open the object 160H, and the object 160H may or may not be further secured through another magnetic coupling to magnetic hub 135R.

Fourth, the various configurations of second suspensions 130 in FIG. 17 illustrate that the functionality of the first and second suspensions 110, 130 may be distributed in a number of different ways between the first and second suspensions 110, 130. More particularly, by including a second magnetic member 265 in a second suspension 130, the second suspension 130 has incorporated the functionality of a first suspension 110, namely, providing magnetic coupling to a next second suspension 130, and providing a structure to suspend or support the next second suspension 130.

It should also be noted that while the exemplary embodiments are primarily concerned with providing passive drying for objects such as bags, hats, gloves, and other articles, the exemplary embodiments may also be utilized in conjunction with active drying elements or features, such as fans, blowers, heating elements, etc., and all such additions or variations are within the scope of the invention.

In summary, an exemplary embodiment of the invention provides a passive drying apparatus 100 which comprises a first suspension 110 and a second suspension 130 which is magnetically couplable to the first suspension. The second suspension comprises a first magnetic hub 135 and a first spreader 140 coupled to the first magnetic hub. The second suspension may further comprise a first plurality of spreaders coupled to the first magnetic hub.

In various exemplary embodiments, at least one spreader 140 of the first plurality of spreaders 140 is moveably coupled to the first magnetic hub (e.g., 140$A_1$, 140$B_1$, 140$B_2$, 140C, 140D, 140F, 140$F_1$, 140$F_2$, 140$K_1$, 140$M_1$, 140$N_1$, 140$N_2$), or at least one spreader of the first plurality of spreaders is non-moveably coupled to the first magnetic hub (e.g., 140$A_2$, 140$K_2$, 140E, 140H, 140J, 140L, 140$M_2$), or at least one spreader of the first plurality of spreaders is removably coupled to the first magnetic hub (e.g., 140$B_2$, 140C, 140F), or at least one spreader of the first plurality of spreaders is integrally formed with the first magnetic hub (e.g., 140$A_2$, 140$K_2$, 140J). In another exemplary embodiment, at least one spreader of the first plurality of spreaders is repositionable between open and closed positions (e.g., 140$A_1$, 140$B_1$, 140$B_2$, 140C, 140D, 140F, 140$F_1$, 140$K_1$, 140$F_2$, 140$M_1$, 140$N_1$, 140$N_2$). For example, in a selected embodiment, a first spreader of the first plurality of spreaders is non-moveably coupled to the first magnetic hub (e.g., 140$A_2$) and a second spreader of the first plurality of spreaders is moveably coupled to the first magnetic hub and repositionable between open and closed positions (e.g., 140$A_1$, 140$B_1$, 140$B_2$, 140C). In another exemplary embodiment, all of the spreaders of the first plurality of spreaders are moveably coupled to the first magnetic hub and repositionable between open and closed positions (e.g., 140D, 140$F_1$, 140$F_2$, 140$N_1$). In addition, a first spreader of the first plurality of spreaders (e.g., 140$F_2$, 140C) may have a comparatively longer length than a second spreader of the first plurality of spreaders (e.g., 140$F_1$, 140$B_2$).

In exemplary embodiments, the first plurality of spreaders comprises one or more of the following types of spreaders: flexible (e.g., 140E), articulated (e.g., 140D), rigid (e.g., 140$A_1$, 140$B_1$, 140C, 140F, 140H), repositionable (e.g., 140$A_1$, 140$B_1$, 140$B_2$, 140C, 140D, 140E, 140F, 140$F_1$, 140$K_1$, 140$F_2$, 140$M_1$, 140$N_1$, 140$N_2$), collapsible or extendable (e.g., 140K, 140M), jointed (e.g., 140D), forked (e.g., 140$M_1$, 140$N_2$), hinged (e.g., 140D), slideable (e.g., 140$N_1$), and/or continuous or merged (e.g., 140J or indistinguishable in magnetic hub 135P). An effective length and an orientation of least one spreader of the first plurality of spreaders may be user modifiable. In another exemplary embodiment, each spreader of the first plurality of spreaders has a substantially puncture-resistant termination 155. Additionally, the first plurality of spreaders may comprise at least one primary spreader (e.g., 140$N_1$) and at least one secondary spreader (e.g., 140$N_2$).

A central shaft 150 may be coupled to the first magnetic hub in selected embodiments. In addition, the first plurality of spreaders may be indirectly coupled to the first magnetic hub through the central shaft (e.g., 140$N_1$, 140$N_2$). A second magnetic hub (e.g., 135G) also may be coupled to the central shaft, with a second plurality of spreaders coupled to the second magnetic hub (e.g., 140$F_2$). Each spreader of the second plurality of spreaders may be elongated and extending from the second magnetic hub to a termination 155 having a substantially smooth and curved surface, with at least one spreader of the second plurality of spreaders being longer than at least one spreader of the first plurality of spreaders. In other exemplary embodiments, a second plurality of spreaders (e.g., 140$N_2$) also may be coupled to the central shaft (e.g., 150N) or coupled to at least one spreader of the first plurality of spreaders (e.g., 140$N_1$). The central shaft may be removably, moveably, or non-moveably coupled to the first magnetic hub.

In various exemplary embodiments, the second suspension may further comprise a plurality of struts 290 moveably coupled to the first plurality of spreaders; and a ring 295 moveably coupled to the plurality of struts and moveably coupled to the central shaft.

In exemplary embodiments, the first suspension comprises a suspending member 115 couplable to an external support; and a magnetic member 120 coupled to the suspending member. The suspending member may be of any type, including without limitation any of the following types of suspending members: an open hook arrangement, a hanger arrangement, a closed hook or loop arrangement, a ring arrangement, a suction arrangement, a clamp arrangement, a lateral magnetic suspending member, a flexible hook arrangement, a flexible loop arrangement, an opening or bore arrangement, or a supporting base arrangement (e.g., 115A-115F, 115H, 115J). In addition, in a selected exemplary embodiment, the first suspension (e.g., 110J) further comprises a plurality of spaced-apart magnetic members coupled to the suspending member.

Also in various exemplary embodiments, the first magnetic hub further comprises a first magnet 145 and the magnetic member further comprises a second magnet 125. The first and second magnets are respectively coupled to the first magnetic hub and to the magnetic member through respective sockets (e.g., 165) or surface mounting (e.g., 145M).

In various exemplary embodiments, at least one spreader of the first plurality of spreaders has at least one of the following: a void, an opening (245, 250), a cavity, a dimple, a raised bump, or a protrusion (255). In addition, the first magnetic hub may be formed integrally with a continuous spreader (135P) having at least one of the following: a void, an opening (250), a cavity, a dimple, a raised bump, or a protrusion (e.g., 255).

In another exemplary embodiment, a passive drying apparatus comprises a first suspension and a second suspension magnetically couplable to the first suspension, with the second suspension comprising: a first magnetic hub; and a first plurality of spreaders coupled to the first magnetic hub.

In yet another exemplary embodiment, a passive drying apparatus comprises a first suspension and a second suspension magnetically couplable to the first suspension. In the exemplary embodiment, the first suspension comprises a suspending member couplable to an external support, and a magnetic member coupled to the suspending member; and the second suspension comprises a first magnetic hub.

A passive drying apparatus, in another exemplary embodiment, comprises a first suspension, a second suspension magnetically couplable to the first suspension, and a central shaft. The first suspension comprises a suspending member removably couplable to an external support, and a magnetic member coupled to the suspending member, with the magnetic member having a first magnet. The second suspension comprises a first magnetic hub having a second magnet, and at least one spreader coupled to the first magnetic hub. In this embodiment, the central shaft or at least one spreader is moveably coupled to the first magnetic hub.

In yet another exemplary embodiment, the invention provides a suspendable apparatus for drying a flexible object. In this embodiment, the apparatus comprises: a first magnetic support structure having a first suspension arrangement removably couplable to an external support; and a second magnetic support structure magnetically couplable through the object to the first magnetic support structure, with the second support structure comprising: a central hub (135, 225); and a plurality of elongated arms (140) coupled to and extendable from the central hub for suspending the object in an open position, with a first elongated arm (140A) of the plurality of elongated arms having a fixed position with respect to the central hub (e.g., when the first elongated arm is integrally formed with the central hub). In this embodiment, a second elongated arm (140B, 140C, 140D, 140F, 140H) of the plurality of elongated arms may be repositionable with respect to the central hub (135, 225) to form an open position and a closed position of the apparatus. In this embodiment, the apparatus may also further comprise a central shaft coupled to the central hub, wherein the central shaft is removably coupled to the central hub, moveable about the central hub structure, or integrally formed with the central hub structure.

Numerous advantages of the present invention are readily apparent. The various embodiments of the invention provide for passive drying of many types of objects such as plastic bags, gloves, hats, shorts, other articles of clothing, and other objects which are not self-supporting or otherwise maintainable in an open position when wet. The exemplary apparatus embodiments provide for significant air circulation and exposure for readily drying such an object, and once the object is appropriately placed within the apparatus, the exemplary embodiments do not require any user involvement during the drying process. The exemplary embodiments provide for securing and holding an object in an open position for drying, and for suspending an object from virtually any type of external support, such as a kitchen cabinet, a curtain rod, a shower head, or a shelf. The exemplary apparatus embodiments may be integrally formed or readily assembled with few parts, providing for ease and low cost of manufacture, with a resulting low cost to consumers. The invention also provides for repositionable spreaders having an open position for holding an object open for drying, which may be manipulated by the user to accommodate objects of different sizes and shapes, and which may be further repositioned into a closed position for compact storage. Exemplary embodiments may also be implemented using aesthetically pleasing or decorative designs for use and display in a modern kitchen or other room.

Although the invention has been described with respect to specific embodiments thereof, these embodiments are merely illustrative and not restrictive of the invention. In the description herein, numerous specific details are provided, such as examples of structural components, materials, and structural variations, to provide a thorough understanding of embodiments of the present invention. One skilled in the relevant art will recognize, however, that an embodiment of the invention can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present invention. In addition, the various Figures are not drawn to scale and should not be regarded as limiting.

Reference throughout this specification to "one embodiment", "an embodiment", or a specific "embodiment" means that a particular feature, structure, or characteristic described in connection with the embodiment is included in at least one embodiment of the present invention and not necessarily in all embodiments, and further, are not necessarily referring to the same embodiment. Furthermore, the particular features, structures, or characteristics of any specific embodiment of the present invention may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

It will also be appreciated that one or more of the elements depicted in the Figures can also be implemented in a more separate or integrated manner, or even removed or rendered inoperable in certain cases, as may be useful in accordance with a particular application. Integrally formed combinations of components are also within the scope of the invention, particularly for embodiments in which a separation or combination of discrete components is unclear or indiscernible. In addition, use of the term "coupled" herein, including in its various forms such as "coupling" or "couplable", means and includes any direct or indirect structural or magnetic coupling, connection or attachment, or adaptation or capability for such a direct or indirect structural or magnetic coupling, connection or attachment, including integrally formed components and components which are coupled via or through another component. Furthermore, the disjunctive term "or", as used herein and throughout the claims that follow, is generally intended to mean "and/or", having both conjunctive and disjunctive meanings (and is not confined to an "exclusive or" meaning), unless otherwise indicated. As used in the description herein and throughout the claims that follow, "a", "an", and "the" include plural references unless the context clearly dictates otherwise. Also as used in the description herein and throughout the claims that follow, the meaning of "in" includes "in" and "on" unless the context clearly dictates otherwise.

The foregoing description of illustrated embodiments of the present invention, including what is described in the summary or in the abstract, is not intended to be exhaustive or to limit the invention to the precise forms disclosed herein. From the foregoing, it will be observed that numerous variations, modifications and substitutions are intended and may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

It is claimed:

1. An apparatus for drying a first object, the apparatus comprising:

a first magnetic suspension comprising:

a suspending member removably couplable to an external support; and a first magnetic member coupled to the suspending member; and a second magnetic suspension separate from and magnetically and removably couplable to the first suspension, the second suspension comprising:

a first magnetic hub to magnetically secure the first object between the first magnetic hub and the first magnetic suspension, the first magnetic hub further comprising a first set of elongated spreaders, a first elongated spreader of the first set of elongated spreaders extending laterally from the first magnetic hub on a first side and a second elongated spreader of the first set of elongated spreaders extending laterally from the first magnetic hub on a second side opposite the first side;

at least one second set of elongated spreaders having a center and having first and second elongated spreaders extending laterally from its center on opposite sides, the at least one second set of elongated spreaders moveably coupled at its center through a mating, snap-fit interlocking ball and socket coupling to the first magnetic hub in between the first and second elongated spreaders of the first set of elongated spreaders, wherein the second set of elongated spreaders is rotatably movable into an open position extending substantially perpendicular to the first set of elongated spreaders; and a central shaft having a first end and a second end, the first end of the central shaft moveably coupled through a ball and socket coupling to the at least one second set of elongated spreaders and movable into an open position extending substantially perpendicular to the first and second sets of elongated spreaders.

2. The apparatus of claim 1, wherein one or more elongated spreaders of the first or second sets of elongated spreaders further comprises a plurality of articulated or jointed segments.

3. The apparatus of claim 1, wherein one or more elongated spreaders of the first or second sets of elongated spreaders is flexible.

4. The apparatus of claim 1, wherein one or more elongated spreaders of the first or second sets of elongated spreaders is collapsible or extendable along its length.

5. The apparatus of claim 1, wherein one or more elongated spreaders of the first or second sets of elongated spreaders has a forked termination.

6. The apparatus of claim 1, further comprising:

a second magnetic member coupled to the second end of the central shaft; and at least one third set of elongated spreaders moveably coupled to the second magnetic member on opposite sides and moveable to extend in an open position laterally from second magnetic member, the at least one third set of elongated spreaders having a different length than the at least one second set of elongated spreaders.

7. The apparatus of claim 1, further comprising:

a second magnetic member coupled to the second end of the central shaft; and a third magnetic suspension separate from and magnetically and removably couplable to the second magnetic member, the third magnetic suspension comprising:

a second magnetic hub to magnetically secure a second object between the second magnetic hub and the second magnetic member; and at least one third set of elongated spreaders moveably coupled to the second magnetic hub, wherein the at least one third set of elongated spreaders is movable into an open position extending substantially laterally from the second magnetic hub and in a direction substantially perpendicular to the central shaft.

8. The apparatus of claim 1, wherein the first or second sets of elongated spreaders comprise at least one type of spreader selected from the group consisting of: flexible, articulated, rigid, repositionable, collapsible, extendable, jointed, forked, hinged, or slideable.

9. The apparatus of claim 1, wherein one or more elongated spreaders of the first or second sets of elongated spreaders has a substantially curved and puncture-resistant termination.

10. The apparatus of claim 1, wherein the suspending member is at least one type of suspending member selected from the group consisting of: an open hook arrangement, a hanger arrangement, a closed hook arrangement, a ring arrangement, a suction arrangement, a clamp arrangement, a lateral magnetic suspending member, a flexible hook arrangement, a flexible loop arrangement, an opening arrangement, a bore arrangement, or a supporting base arrangement.

11. The apparatus of claim 1, wherein the first magnetic suspension further comprises a plurality of spaced-apart first magnetic members coupled to the suspending member.

12. The apparatus of claim 1, wherein one or more elongated spreaders of the first or second sets of elongated spreaders has at least one of the following: a void, an opening, a cavity, a dimple, a raised bump, or a protrusion.

13. An apparatus for drying a first object, the apparatus comprising:

a first magnetic suspension comprising:

a suspending member removably couplable to an external support; and a first magnetic member coupled to the suspending member; and a second magnetic suspension separate from and magnetically and removably couplable to the first suspension, the second suspension comprising:

a first magnetic hub to magnetically secure the first object between the first magnetic hub and the first magnetic suspension, the first magnetic hub further comprising a first set of elongated spreaders, a first elongated spreader of the first set of elongated spreaders extending laterally from the first magnetic hub on a first side and a second elongated spreader of the first set of elongated spreaders extending laterally from the first magnetic hub on a second side opposite the first side;

a second set of elongated spreaders having a center and having first and second elongated spreaders extending laterally from its center on opposite sides, the second set of elongated spreaders moveably coupled at its center through a mating, snap-fit interlocking ball and socket coupling to the first magnetic hub, wherein the second set of elongated spreaders is rotatably movable into an open position extending substantially laterally from the first magnetic hub and perpendicular to the first set of elongated spreaders;

a third set of elongated spreaders having a center and having first and second elongated spreaders extending laterally from its center on opposite sides, the third set of elongated spreaders moveably coupled at its center through a mating, snap-fit interlocking ball and socket coupling to the second set of elongated spreaders, the third set of elongated spreaders having a different length than the second set of elongated spreaders, the third set of elongated spreaders rotatably movable into an open position perpendicular to the first set of elongated spreaders; and a central shaft having a first end and a second end, the first end of the central shaft moveably coupled through a ball and socket coupling to the third set of elongated spreaders and movable into an open position extending substantially perpendicular to the first, second and third sets of elongated spreaders.

14. The apparatus of claim 13, wherein one or more elongated spreaders of the first, second or third sets of elongated spreaders is flexible or comprise a plurality of articulated or jointed segments.

15. The apparatus of claim 13, wherein the suspending member is at least one type of suspending member selected from the group consisting of: an open hook arrangement, a hanger arrangement, a closed hook arrangement, a ring arrangement, a suction arrangement, a clamp arrangement, a lateral magnetic suspending member, a flexible hook arrangement, a flexible loop arrangement, an opening arrangement, a bore arrangement, or a supporting base arrangement.

16. The apparatus of claim 13, further comprising:

a second magnetic member coupled to the second end of the central shaft; and a third magnetic suspension separate from and magnetically and removably couplable to the second magnetic member, the third magnetic suspension comprising:

a second magnetic hub to magnetically secure a second object between the second magnetic hub and the second magnetic member; and at least one fourth set of elongated spreaders moveably coupled to the second magnetic hub and movable into an open position extending substantially laterally from the second magnetic hub and in a direction substantially perpendicular to the central shaft.

17. An apparatus for drying a first object, the apparatus comprising:

a first magnetic suspension comprising:

a suspending member comprising a hook removably couplable to an external support; and a first magnetic member coupled to the suspending member; and a second magnetic suspension separate from and magnetically and removably couplable to the first suspension, the second suspension comprising:

a first magnetic hub to magnetically secure the first object between the first magnetic hub and the first magnetic suspension, the first magnetic hub further comprising a first set of elongated spreaders, a first elongated spreader of the first set of elongated spreaders extending laterally from the first magnetic hub on a first side and a second elongated spreader of the first set of elongated spreaders extending laterally from the first magnetic hub on a second side opposite the first side;

at least one second set of elongated spreaders having a center and having first and second elongated spreaders extending laterally from its center on opposite sides, the at least one second set of elongated spreaders moveably coupled at its center through a mating, snap-fit interlocking ball and socket coupling to the first magnetic hub in between the first and second elongated spreaders of the first set of elongated spreaders, wherein the second set of elongated spreaders is rotatably movable into an open position extending substantially perpendicular to the first set of elongated spreaders; and a central shaft having a first end and a second end, the first end of the central shaft moveably coupled through a ball and socket coupling to the at least one second set of elongated spreaders and movable into an open position extending substantially perpendicular to the first and second sets of elongated spreaders.

* * * * *